US007472985B2

(12) United States Patent
Endo et al.

(10) Patent No.: US 7,472,985 B2
(45) Date of Patent: Jan. 6, 2009

(54) LIQUID EJECTING APPARATUS, RECORDING APPARATUS, ABSORBING MEMBER AND INK COLLECTING UNIT

(75) Inventors: Tsunenobu Endo, Nagano-ken (JP); Sanshiro Takeshita, Nagano-ken (JP); Hidetoshi Kodama, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 499 days.

(21) Appl. No.: 11/356,653

(22) Filed: Feb. 16, 2006

(65) Prior Publication Data

US 2006/0181577 A1 Aug. 17, 2006

(51) Int. Cl.
*B41J 2/06* (2006.01)

(52) U.S. Cl. ..... 347/55; 347/31; 347/36

(58) Field of Classification Search ..... 347/22, 347/23, 24, 29–31, 34–36, 44, 50, 55, 104, 347/112

See application file for complete search history.

(56) References Cited

U.S. PATENT DOCUMENTS 6,802,591 B2 * 10/2004 Takahashi ..... 347/36
6,860,583 B2 * 3/2005 Cheney et al. ..... 347/35

* cited by examiner

*Primary Examiner*—Juanita D Stephens
(74) *Attorney, Agent, or Firm*—Edwards Angell Palmer & Dodge LLP; John J. Penny, Jr.

(57) ABSTRACT

There is provided a liquid ejecting apparatus including a liquid ejecting head that has a conductive nozzle plate and discharges liquid from openings of the nozzle plate to recording material, a conductive absorbing member that is arranged opposite the nozzle plate in a direction in which liquid is discharged and absorbs the liquid not attached to the recording material, an electrode that is electrically connected to the absorbing member, and a voltage generating means that generates a voltage to electrically attract the liquid to the electrode side by applying an electric field not less than 25 kV/m and not more than 250 kV/m between the nozzle plate and the electrode.

23 Claims, 22 Drawing Sheets

LIQUID EJECTING APPARATUS, RECORDING APPARATUS, ABSORBING MEMBER AND INK COLLECTING UNIT

CROSS REFERENCE TO THE RELATED APPLICATION

The present application claims priority from Japanese Patent Applications Nos. JP 2005-039297 filed on Feb. 16, 2005, JP 2005-047895 filed on Feb. 23, 2005, and JP 2005-133421 filed on Apr. 28, 2005, the contents of which are incorporated herein by reference.

BACKGROUND OF THE INVENTION

1. Field of the Invention

The present invention relates to a liquid ejecting apparatus. More particularly, the present invention relates to a liquid ejecting apparatus that makes liquid discharged from openings of a nozzle plate mounted on a liquid ejecting head adhere to recording material.

2. Description of Related Art

When a liquid ejecting apparatus makes liquid adhere to recording material without leaving blank space on the peripheral border of the recording material, the liquid ejecting apparatus anticipates unavoidable displacement between the recording material and a liquid ejecting head so that the liquid is ejected over a region slightly wider than the dimension of the recording material. For this reason, the liquid is discharged to an area, on which the recording material is not located, in the neighborhood of both side edges and upper and lower ends of the recording material. Thus, in order to prevent surplus liquid from flying in all directions and contaminating the periphery, an absorbing member is arranged at a position facing the liquid ejecting head in the direction in which the liquid is discharged to cause the absorbing member to absorb the surplus liquid not adhered to the recording material.

In addition, recording material may extend and crease by adhering liquid over the material. At this time, when the extended recording material contacts with the absorbing member by bending of the material due to wrinkles, the recording material is adhered to the liquid, which has already been absorbed in the absorbing member, to be contaminated. Thus, in anticipation of the extension of the recording material, a gap of around 2 to 4 mm is provided between the recording material and the absorbing members in the liquid ejecting apparatus. In addition, an interval of around 1 mm is provided between the liquid ejecting head and the recording material.

On the other hand, upon request of resolution improvement of a recording image, a recent liquid ejecting apparatus miniaturizes droplets discharged from openings of a nozzle plate to the degree of several pl. Since such a minute droplet has extremely small mass, a droplet, which has once been discharged, rapidly loses kinetic energy due to viscous resistance of an atmosphere. Specifically, the velocity of a droplet less than, e.g., 8 pl reaches generally zero after the droplet flies around 3 mm in the atmosphere. A minute droplet losing kinetic energy takes a balance between falling motion by acceleration of gravity and viscous resistance force of an atmosphere, and thus requires long time up to termination of falling.

In addition, in the case of a distance of 3 to 5 mm obtained by adding the gap between the nozzle plate and the recording material to the interval between the recording material and the absorbing member, the discharge velocity of the liquid ejecting apparatus for a droplet of 3 pl is set highly in order to transfer the droplet from the nozzle plate to a surface of the absorbing member. However, viscous resistance of the atmosphere acting on the droplet further increases so as to reduce travel distance on the contrary.

On the other hand, the discharge velocity of the liquid ejecting apparatus is set highly in order to transfer the droplet by 3 to 5 mm obtained by adding a gap between the liquid ejecting head and the recording material and a gap between the recording material and the absorbing member. However, an influence of viscous resistance of the atmosphere acting on the droplet of about 3 pl further increases so as to reduce travel distance on the contrary.

Moreover, when the discharge velocity is high, an extremely minute droplet referred to as satellite ink generated when the droplet leaves the nozzle plate is easy to be generated.

Furthermore, the liquid ejecting apparatus periodically repeats an operation referred to as flushing. The flushing is an operation of sending a driving signal to the liquid ejecting head in a state that the recording material is not in the apparatus, so to speak, to attack liquid. By such an operation, liquid having increased viscosity is removed from a nozzle with a little discharge volume. However, since liquid discharged during this flushing is consumed for only flushing and thus does not contribute to recording to the recording material, a small droplet is discharged to save consumption of liquid. Moreover, since time required for flushing reduces throughput of an original recording operation, liquid is discharged from all nozzles in the shortest time in the flushing. In such a flushing operation, a large quantity of satellite ink is generated.

Most of satellite ink generated as a result of various events as described above becomes aerosol floating in the vicinity of a traveling area of the liquid ejecting head. A part of the aerosol floats to the outside of the liquid ejecting apparatus and adheres to the perimeter of the liquid ejecting apparatus. Moreover, most of aerosol adheres to each portion in the liquid ejecting apparatus before long. Especially, when aerosol adheres on a carrying path of recording material such as a platen, recording material to be next carried is contaminated. Furthermore, when aerosol adheres to an electric circuit, a linear scale, various optical sensors, and so on of the liquid ejecting apparatus, malfunction of the apparatus may be caused. Moreover, when a user touches a part to which aerosol adheres, a hand of the user is also contaminated.

Japanese Patent Application Publication No. 2004-202867 discloses a liquid ejecting apparatus including a function of collecting the aerosol actively.

A liquid ejecting apparatus disclosed in this patent document includes an absorbing member that is arranged at a position facing a nozzle plate in order to absorb surplus liquid that does not adhere to recording material. Moreover, one electrode is a metallic component arranged on a surface of the absorbing member, and the other electrode is a nozzle plate made of metal having openings for discharging liquid. When voltages different from each other are applied to these electrode and nozzle plate, an electric field is formed between them. Moreover, droplets discharged from the nozzle plate in such a liquid ejecting apparatus are charged with electricity to be the same electrode as that of the nozzle plate when being discharged from the nozzle plate. For this reason, since droplets floating as aerosols are charged with electricity, the droplets head for an electrode without being decelerated by coulomb force acting between the droplet and an electric field, and are adsorbed to the electrode having the polarity opposite to that of the droplets. The droplets adsorbed to the electrode are absorbed by a capillary phenomenon, and are finally absorbed in the absorbing member.

The above-described apparatus has applied an extremely high voltage in order to form an electric field for collecting aerosol. For example, the Japanese Patent Application Publication No. 2004-202867 discloses that a 3-kilovolt voltage is applied in order to obtain the electric field. This voltage is equivalent to generating an electric field of 1 MV/m assuming that a distance between the nozzle plate and the absorbing member is 3 mm.

Moreover, in order to form an effective electric field between the nozzle plate and the absorbing member in the above-described liquid ejecting apparatus, a corresponding voltage between them, e.g., several hundred volts or more is applied. In the case of an ink-jet type recording apparatus that is an example of a liquid ejecting apparatus, when forming an electric field of the degree of 80 kV/m effective for collecting satellite ink, the voltage of around 350V is applied between the nozzle plate and a recording material side electrode. If the nozzle plate is a ground level, it is expected that a 350-volt voltage is applied to the recording material side electrode. Therefore, for example, when a user puts his/her hand in the apparatus and touches the recording material side electrode in order to remove a jammed recording material, possibility of an electric shock is high. Moreover, when changing a liquid cartridge, a user may reluctantly put his/her hand in a case. In this case, the user may also touch an electrode to which a high voltage is applied without discretion and thus receive an electric shock.

SUMMARY OF THE INVENTION

Therefore, it is an object of the present invention to provide a liquid ejecting apparatus that can solve the foregoing problems. The above and other objects can be achieved by combinations described in the independent claims. The dependent claims define further advantageous and exemplary combinations of the present invention.

To solve the problems, according to the first aspect of the present invention, there is provided a liquid ejecting apparatus. The liquid ejecting apparatus includes: a liquid ejecting head that has a conductive nozzle plate and discharges liquid from openings of the nozzle plate to recording material; an absorbing member that is arranged opposite the nozzle plate in a direction in which liquid is discharged and absorbs the liquid not attached to the recording material; an electrode that is arranged next to the absorbing member; and a voltage generating means that generates a voltage to electrically attract the liquid to the electrode side by applying an electric field not less than 25 kV/m and not more than 250 kV/m between the nozzle plate and the electrode. In this way, it is possible to collect aerosols by means of an electric field generated by a low applied voltage.

In addition, as described above, the liquid ejecting apparatus can collect aerosols if an electric field not less than 25 kV/m is formed. Furthermore, the effect conspicuously increases by applying an electric field not less than 80 kV/m.

Moreover, in the liquid ejecting apparatus, the voltage generating means may apply a low electric field between the nozzle plate and the electrode in inverse proportion to a height of a liquid column grown from the opening of the nozzle plate until the liquid column is discharged as a liquid drop. That is, since electric charge charged in a droplet becomes high in proportion to a height of a liquid column, it is possible to reduce an electric field generated by the voltage generating means in order that the droplet arrives at the electrode.

According to the second aspect of the present invention, there is provided a recording apparatus. The recording apparatus includes: a recording head that has a conductive nozzle plate and discharges liquid from openings of the nozzle plate to recording material; an absorbing member that is arranged opposite the nozzle plate in a direction in which ink is discharged and absorbs the ink not attached to the recording material; an electrode that is arranged next to the absorbing member; and a voltage generating means that generates a voltage to electrically attract the ink to the electrode side by applying an electric field not less than 25 kV/m and not more than 250 kV/m between the nozzle plate and the electrode. In this way, it is possible to collect aerosols of ink by means of an electric field generated by a low applied voltage in the recording apparatus.

According to the third aspect of the present invention, there is provided an absorbing member that is arranged opposite a recording head in a recording apparatus for discharging ink from the recording head to recording material. The absorbing member is formed of a conductive porous material of which surface resistance has a resistance value not more than $10^8\Omega$. In this way, it is possible to surely collect aerosols.

There is provided an ink collecting unit that is arranged opposite a recording head in a recording apparatus for discharging ink from the recording head to recording material. The ink collecting unit includes: an absorbing member that is formed of a conductive porous material of which surface resistance has a resistance value not more than $10^8\Omega$; and a platen that accommodates the absorbing member and supports the recording material. In this way, it is possible to surely collect aerosols. The ink collecting unit may further include an electrode that is electrically connected to the absorbing member.

To solve the problems, according to the fourth aspect of the present invention, there is provided a liquid ejecting apparatus. The liquid ejecting apparatus includes: a liquid ejecting head that has a conductive nozzle plate and discharges liquid from openings of the nozzle plate to recording material; a recording material side electrode that is arranged opposite the nozzle plate farther than the recording material in a direction in which liquid is discharged; a voltage generating means that generates a voltage between the nozzle plate and the recording material side electrode to electrically attract the liquid to the electrode side; an opening and closing detecting section that detects opening and closing of a case covering at least the liquid ejecting head and the recording material side electrode; and a voltage stopping means that stops generating a voltage between the nozzle plate and the recording material side electrode when the opening and closing detecting section has detected the opening of the case. In this way, it is possible to prevent an electric shock of a user even when the user touches the nozzle plate and the electrode.

In the liquid ejecting apparatus, the voltage stopping means may electrically insulate the voltage generating means from the nozzle plate, the voltage generating means from the recording material side electrode, or the voltage generating means from the nozzle plate and the recording material side electrode. In this way, it is possible to stop generating a voltage as quickly as possible after the case is opened.

In the liquid ejecting apparatus, the voltage stopping means may prohibit the voltage generating means from generating a voltage. In this way, it is also possible to prevent an electric shock of a user.

The liquid ejecting apparatus may further include an error detecting section that detects an operating error of the liquid ejecting apparatus, and the voltage stopping means may stop generating a voltage between the nozzle plate and the recording material side electrode when the error detecting section detects an operating error. In this way, when it is considered that a short occurs between the nozzle plate and the electrode due to a paper jam, it is possible to stop generating a voltage to prevent an excess current from flowing by a short.

The liquid ejecting apparatus may further include an attachment and detachment detecting section that detects whether a detachable ink cartridge for supplying ink to the liquid ejecting head is in attaching and detaching work, and the voltage stopping means may stop generating a voltage between the nozzle plate and the recording material side electrode when the attachment and detachment detecting section detects that the ink cartridge is in attaching and detaching work. In this way, it is also possible to surely prevent an electric shock of a user.

The liquid ejecting apparatus may further include a charge discharging means that discharges electric charge accumulated in at least one of the recording material side electrode and the voltage generating means when the voltage stopping means is operated. In this way, an electric shock by a discharge of electric charge accumulated in an apparatus is prevented in addition to an electric shock caused by a voltage applied by the voltage generating means.

The summary of the invention does not necessarily describe all necessary features of the present invention. The present invention may also be a sub-combination of the features described above.

BRIEF DESCRIPTION OF THE DRAWINGS

The above and other objects and features and advantages of the present invention will become more apparent from the following description of the presently preferred exemplary embodiments of the invention taken in conjunction with the accompanying drawings, in which.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Figure 1:
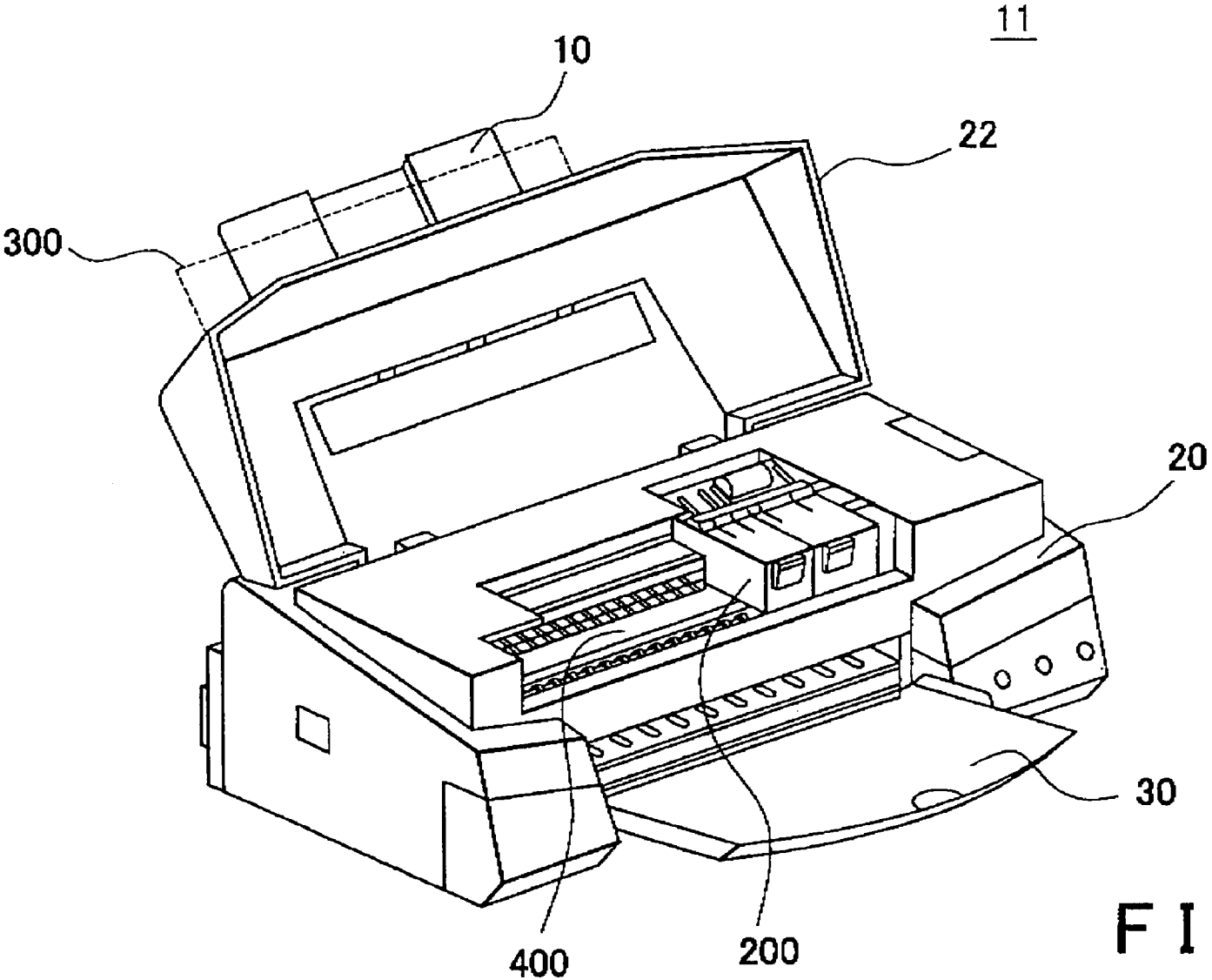
FIG. 1 is a perspective view surveying the whole of an ink-jet type recording apparatus.

FIG. 1 is a perspective view surveying an ink-jet type recording apparatus 11 that is an example of a liquid ejecting apparatus that may be an embodiment of the present invention, and shows a state that a top case 22 as a cover is opened. As shown in the present drawing, the ink-jet type recording apparatus 11 includes a bottom case 20 that is a base of the apparatus, a top case 22 that forms a casing with the bottom case 20, a hopper 10 that is mounted to a rear portion of the bottom case 20, and a discharge tray 30 that is formed on a front face of the bottom case 20. Moreover, the ink-jet type recording apparatus 11 includes a platen 400 that is horizontally arranged in the bottom case 20 and a carriage 200 that is arranged on the upper side of the platen 400, on the inner side of the casing.

In the ink-jet type recording apparatus 11 as described above, recording material 300 accommodated on the hopper 10 is sent onto the platen 400 one piece by one piece by means of a carrying-in section not shown, and is further sent to a discharge tray 30 by means of a discharging section not shown. Moreover, in the ink-jet type recording apparatus 11, the carriage 200 reciprocates in the direction perpendicular to a transportation direction of the recording material 300 on the upper side of the platen 400. Therefore, since the transportation of the recording material 300 and the reciprocation of the carriage 200 are performed alternately, the whole top face of the recording material 300 can be scanned by the carriage 200 and thus a record operation can be performed at an arbitrary position on the recording material 300.

Figure 2:
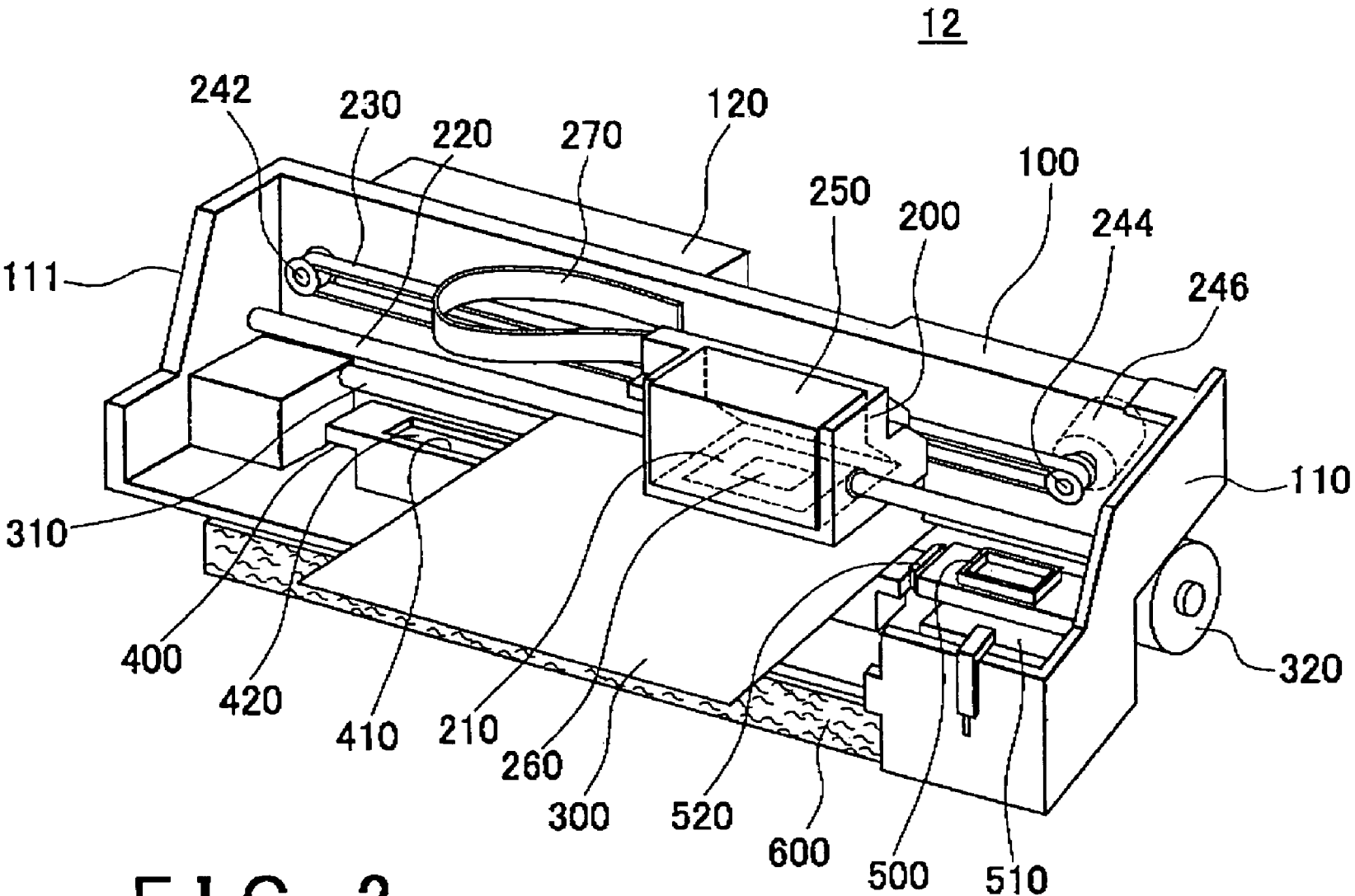
FIG. 2 is a perspective view showing the vicinity of an internal mechanism of an ejecting apparatus shown in FIG. 1.

FIG. 2 is a perspective view showing an internal mechanism 12 of the ink-jet type recording apparatus 11 shown in FIG. 1 by pulling out a frame 100 and side face portions 110 and 111. As shown in the present drawing, the internal mechanism 12 is mainly formed inside an area bounded by the frame 100 that is arranged backward and generally vertically and a pair of side face portions 110 and 111 that are extended from both ends of the frame 100 to the front parallel to each other.

As shown in the present drawing, in the internal mechanism 12, the carriage 200 is supported by a guide shaft 220 penetrating through the carriage. Both ends of the guide shaft 220 are supported by the side face portion 110 and the side face portion 111, and the guide shaft 220 is arranged parallel to the frame 100. Therefore, the carriage 200 can horizontally move along the guide shaft 220.

At the back of the carriage 200, a pair of pulleys 242 and 244 and a timing belt 230 that is hung on the pulleys 242 and 244 are arranged in the front of the frame 100. One pulley 244 is rotationally driven by a carriage motor 246. Moreover, the timing belt 230 is coupled to a rear portion of the carriage 200. Therefore, the carriage 200 can be reciprocated according to an operation of the carriage motor 246.

Moreover, the carriage 200 loads an ink cartridge 250, and also includes a recording head 210 in the lower part. The recording head 210 includes a nozzle plate 260 made of metal including openings to discharge ink. In this way, ink is discharged from the carriage 200 toward the lower side in a form shown in FIG. 2.

Furthermore, the carriage 200 is coupled with an electronic circuit 120 in the rear of the frame 100 via a tape-shaped multicore cable 270. Since the multicore cable 270 is flexibly bended according to a movement of the carriage 200, the multicore cable 270 does not disturb a reciprocation of the carriage 200.

The platen 400 is arranged on the lower side of an area along which the carriage 200 passes. The platen 400 supports the recording material 300 passing along a bottom of the carriage 200 from the lower side, in order to hold a distance between the nozzle plate 260 and the recording material 300 constant. Moreover, a concavity 410 is formed on a top face of the platen 400 and an absorbing member 420 is accommodated in the concavity 410. The absorbing member 420 receives ink discharged from the recording head 210 for an area on which the recording material 300 does not exist. Here, a gap of around 3 to 5 mm is provided between the nozzle plate 260 and the absorbing member 420.

In addition, as the operating time of the ink-jet type recording apparatus 11 elapses, ink adheres to the absorbing member 420. When the recording material 300 comes in contact with the absorbing member 420 to which ink adheres, the recording material 300 is contaminated with ink. Thus, since a protrusion-shaped portion is formed on a top face of the platen 400 to lift and support the recording material 300 from the lower side, an interval between them is maintained to prevent them from being in contact with each other.

Moreover, since a material of the absorbing member 420 included within the platen 400 is selected in consideration of absorption velocity on the surface, absorption capacity is limited. Thus, a larger waste liquid absorbing member 600 is arranged on the lower side of the platen 400, and the absorbing member 600 comes in contact with the absorbing member 420. In the waste liquid absorbing member 600, the absorption capacity is important, and thus a material having large absorbing power by a capillary phenomenon is selected. Therefore, the waste liquid absorbing member 600 can absorb a large quantity of ink from the absorbing member 420.

A carry-in roller 310 is arranged at the back of the platen 400. The carry-in roller 310 is driven by a carrying motor 320 arranged in the rear of the frame 100, and sends the recording material 300 onto the platen 400 in cooperation with a driven roller not shown. As described above, the carriage 200 can reciprocate in the direction perpendicular to a transportation direction of the recording material 300. Therefore, the transportation of the recording material 300 and the reciprocation of the carriage 200 can alternately be performed, whereas the recording head 210 on the undersurface of the carriage 200 can intermittently be operated to discharge and attach ink to an arbitrary area on the recording material 300.

Furthermore, in the internal mechanism 12, a cap member 500 is arranged at a lateral side of the platen 400 near the side face portion 110. The cap member 500 can move up and down, and thus ascends and seals a surface of the nozzle plate 260 when the carriage 200 stops at the home position near the side face portion 110. Moreover, an inside of the cap member 500 is coupled with a pump unit 510. The pump unit 510 can absorb ink attached to the surface of the nozzle plate 260. The ink absorbed by the pump unit 510 is absorbed into the waste liquid absorbing member 600 through a pipe not shown.

Furthermore, a wiping means 520 is arranged between the platen 400 and the cap member 500. When the carriage 200 released from the cap member 500 passes above the wiping means 520, the wiping means 520 wipes out the lower part of the nozzle plate 260 to clean it.

Figure 3:
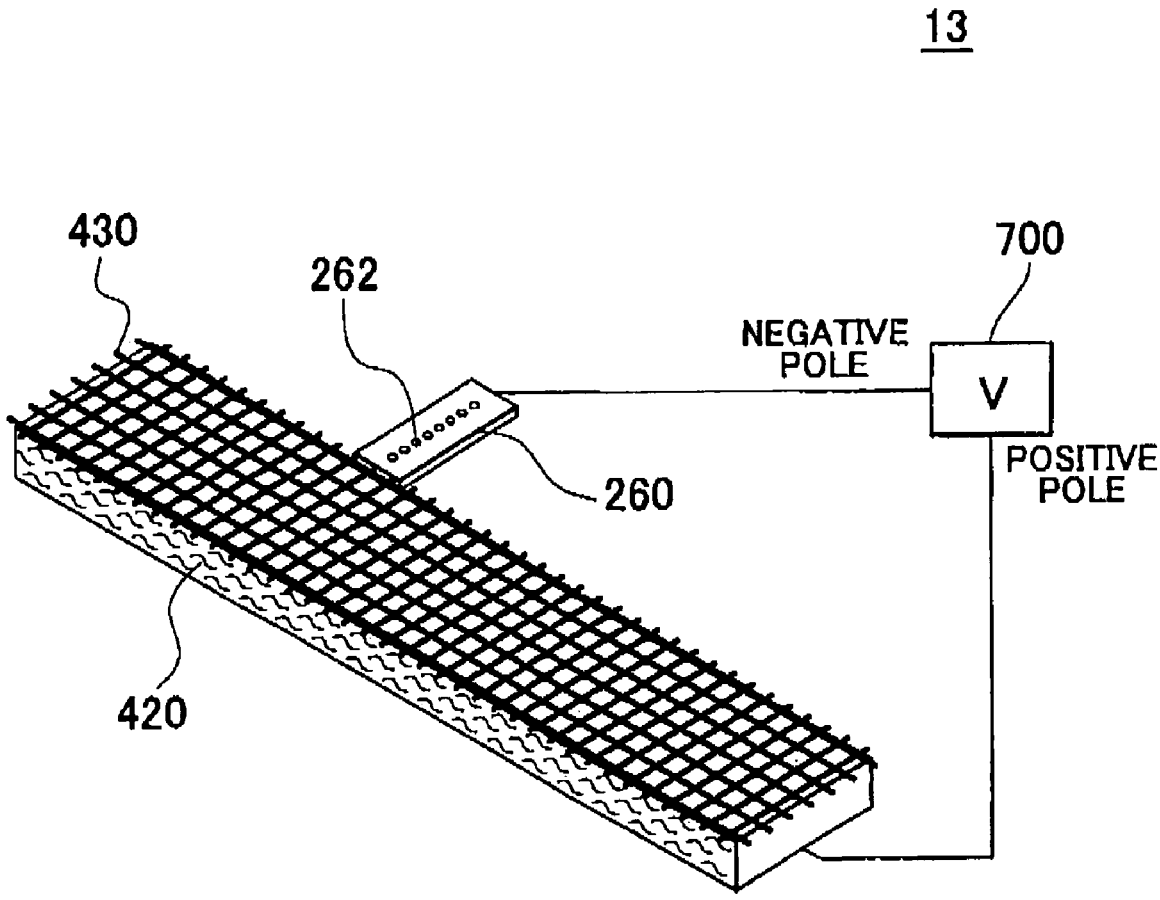
FIG. 3 is a perspective view showing an aerosol collecting mechanism of an ejecting apparatus shown in FIG. 1.

FIG. 3 is a perspective view showing an embodiment of an aerosol collecting mechanism 13 that may be used in the ink-jet type recording apparatus 11 shown in FIG. 1. FIG. 3 also shows electric relation between an electrode 430 disposed in the vicinity of the absorbing member 420 and the nozzle plate 260.

As shown in the present drawing, one end of a voltage generating means 700 is electrically coupled with the electrode 430. The electrode 430 is mounted on a top or upper surface of the absorbing member 420, and the absorbing member 420 is further accommodated in the concavity 410 on the top face of the platen 400 as shown in FIG. 2. In the embodiment shown in FIG. 3, the electrode 430 is arranged to form a mesh which is mounted on and covers substantially an entire area of the top surface of the absorbing member 420. The mesh-like electrode 430 may be formed of an electrically conductive material such as metal or the like.

The other end of the voltage generating means 700 is electrically coupled with the nozzle plate 260. The nozzle plate 260 is formed of a conductor material such as metal, and includes a plurality of openings 262 to discharge ink. In a form shown in FIG. 3, the one end of the voltage generating means 700 is set to a positive pole and the other end is set to a negative pole or a ground.

Figure 4:
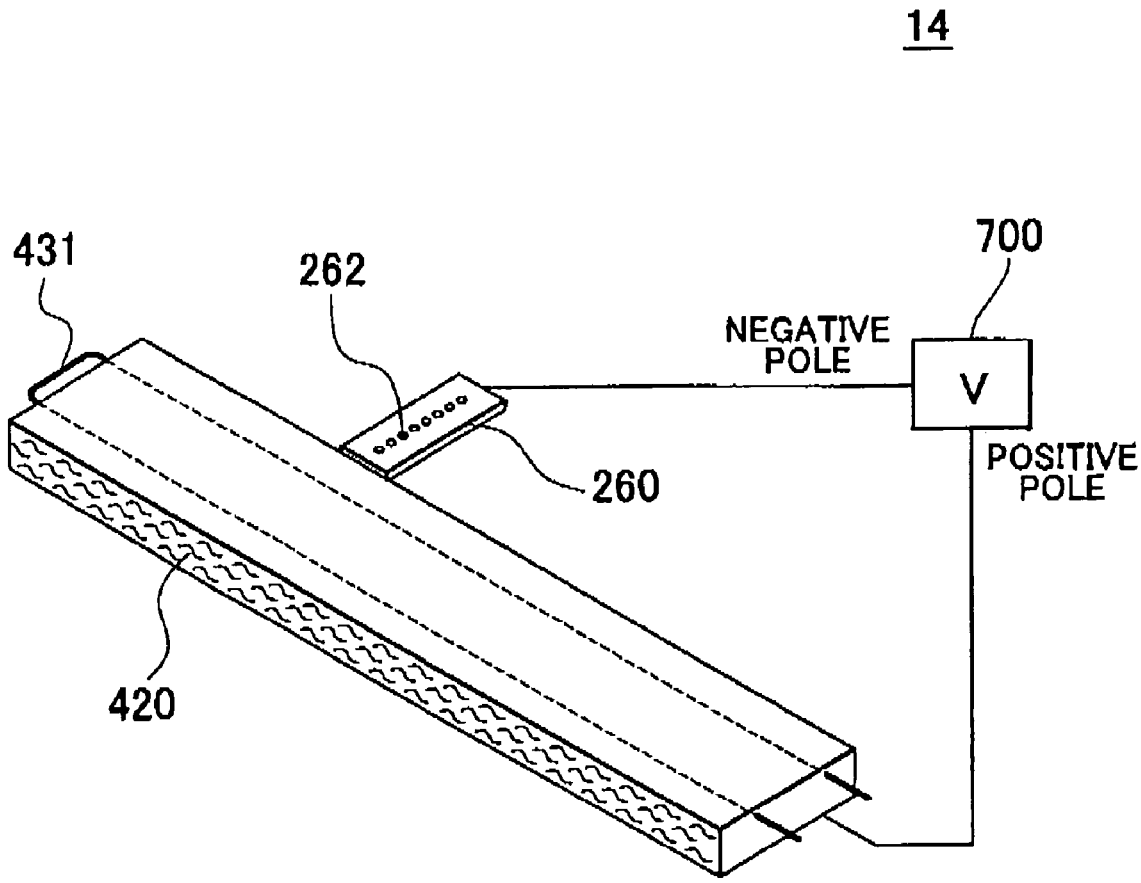
FIG. 4 is a perspective view showing another form of an aerosol collecting mechanism of an ejecting apparatus shown in FIG. 1.

FIG. 4 is a perspective view showing another embodiment of an aerosol collecting mechanism 14 that may be used in the ink-jet type recording apparatus 11 shown in FIG. 1. FIG. 4 also shows electric relation between the electrode 431 near the absorbing member 420 and the nozzle plate 260, As shown in the present drawing, one end of the voltage generating means 700 is electrically coupled with the electrode 431. The electrode 431 is elongated U-shaped and penetrates the absorbing member 420. Further, the absorbing member 420 is accommodated in the concavity 410 on the top face of the platen 400 as shown in FIG. 2. Similarly to an embodiment shown in FIG. 3, the other end of the voltage generating means 700 is coupled with the nozzle plate 260.

In addition, in the aerosol collecting mechanisms 13 and 14 shown in FIGS. 3 and 4, the electrodes 430 and 431 can be formed of metal with corrosion resistance against ink of the ink-jet type recording apparatus 11, for example, wire rod, plate, or foil material of gold, stainless steel, or nickel, or wire rod, plate, or foil material plated with these metals, or a net-like or lattice-like member made by combining these materials. Moreover, the absorbing member 420 and the platen 400 are an example of an ink collecting unit in the present invention. Further, the ink collecting unit may include the electrode.

Moreover, the absorbing member 420 directly receives droplets not attached to the recording material 300 after being discharged from the nozzle plate 260. At this time, when the absorption velocity of ink on a surface of the absorbing member 420 is slow, so-called a milk crown phenomenon occurs due to an impact by which the droplet collides with the surface. A minute droplet occurs on the periphery of a milk crown, and the droplet causes the generation of an aerosol. Thus, a foaming material having high percentage of voids is selected as a material of the absorbing member 420 in serious consideration of the height of absorption velocity.

Further, the absorbing member 420 may be formed of a conductive material having a resistance value of surface resistance less than or equal to $10^8\Omega$. Specifically, a material made by mixing a conductive material such as metal and carbon with resin such as polyethylene and polyurethane, a material made by adhering a conductive material such as metal and carbon to a resin foaming material such as polyethylene and polyurethane, or a material made by plating resin can be used as the absorbing member. Moreover, a material made by impregnating a resin foaming material such as polyethylene and polyurethane with an electrolytic solution can be used as the absorbing member 420.

Figure 5:
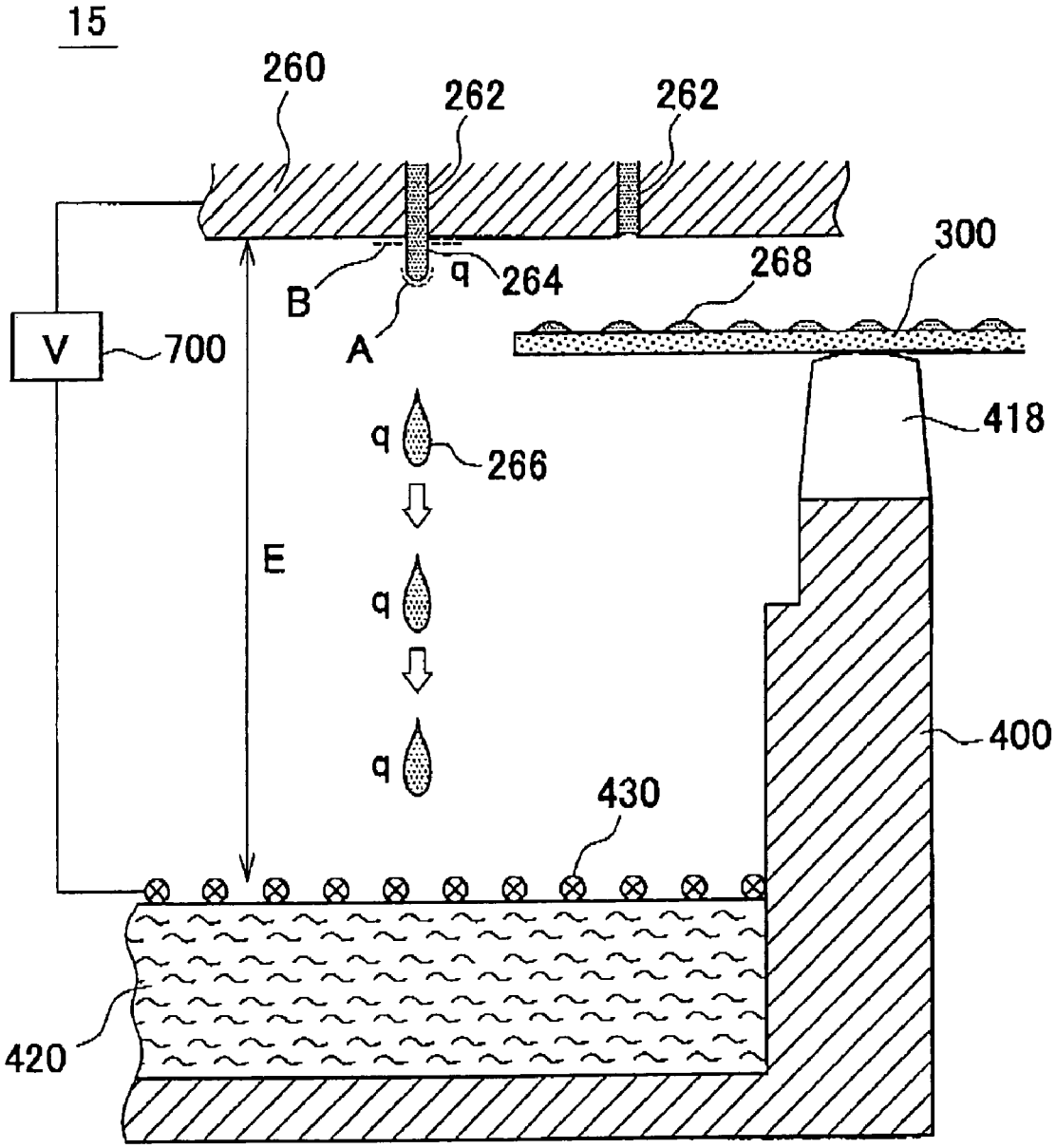
FIG. 5 is a side view explaining an operation of an aerosol collecting mechanism.

FIG. 5 is a conceptual diagram showing an aerosol collecting mechanism 15 in the inkjet type recording apparatus 11 shown in FIGS. 1 and 4. In FIG. 5, the same components as those of FIGS. 1 to 4 have the same reference numerals, and their descriptions will be omitted.

As shown in the present drawing, the plurality of openings 262 for discharging ink is formed in the nozzle plate 260. When the recording material 300 exists right under the nozzle plate 260, the droplet 268 discharged from the nozzle plate 260 adheres to the recording material 300.

However, when attaching ink to edges of the recording material 300 without white space, in side edges and front and rear ends of the recording material 300, the recording material 300 does not exist right under a part of the openings 262. In this case, a kinetic energy given to the droplet 266 by the discharge from the opening 262 is rapidly lost by viscous resistance of an atmosphere, and a part of the droplet is completely lost a long time before arriving at the absorbing member 420. Moreover, since mass of the droplet 266 is small extremely, a falling motion by acceleration of gravity and the viscous resistance force balance each other, and fall velocity of the droplet 266 becomes extremely late. In this way, there is generated an aerosol floating on the lower side of the nozzle plate 260.

Here, as shown in FIG. 5 one end of the voltage generating means 700 is connected to the nozzle plate 260 and the other end of the voltage generating means 700 is connected to the electrode 430. Therefore, an electric field E according to the applied voltage V is formed between the nozzle plate 260 and the electrode 430.

Figure 6:
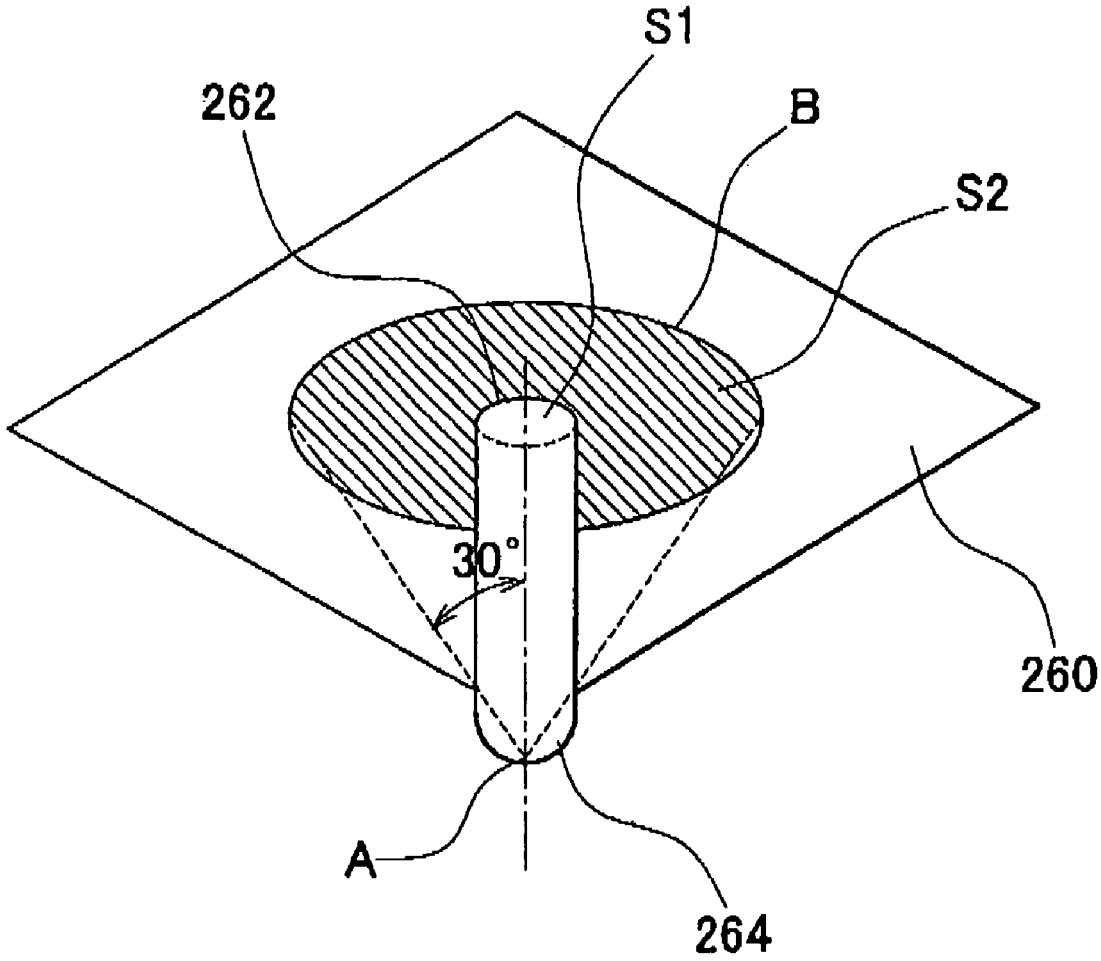
FIG. 6 is an enlarged perspective view showing the vicinity of a nozzle plate shown in FIG. 5.

FIG. 6 is a view enlarging an ink pillar 264 on the surface of the nozzle plate 260 shown in FIG. 5. In the present drawing, the same components as those of the other drawings have the same reference numerals, and their descriptions will be omitted.

The ink pushed out from the opening 262 in the ink-jet type recording apparatus 11 becomes an ink pillar 264 drooping from the nozzle plate 260 at the moment just before the ink becomes the droplet 266. At this time, so-called lightning conductor effect occurs between a leading end A of the ink pillar 264 and the lower part of the nozzle plate 260 on an area B in the vicinity of the ink pillar 264. That is, the above lightning conductor effect means that the area B on the surface of the nozzle plate 260 surrounded with a conical shape including a range of a vertex angle from 50° to 60° with the leading end A (a bottom end in the present drawing) of the ink pillar 264 at the top contributes to the charge of the droplet 266. By this lightning conductor effect, the droplet 266 has an electric charge larger than an electric charge corresponding to a horizontal cross section of the ink pillar 264.

The ink pillar 264 becomes the droplet 266 apart from the nozzle plate 260 before long. However, this droplet 266 is charged with an electric charge q accumulated by the lightning conductor effect as described above. Therefore, the droplet 266 having the charge q obtains a kinetic energy by a coulomb force Fe (qE) from an electric field E, and thus moves on the lower side without deceleration to finally arrive at the absorbing member 420.

Here, assuming that the diameter of opening 262 is "d", the radius of opening 262 is "r", and the height of ink pillar 264 is "h", the area $S_1$ of the area A can be shown with "$\pi r^2$".

On the other hand, when a vertex angle of the area B caused by a lightning conductor effect in the leading end A of the ink pillar 264 having the height "h" is 30°, the area S2 of an area surrounded by the vertex angle of the area B in the surface of the nozzle plate 260 can be shown with "$\pi\{h\cdot\tan(30°)\}^2$", and this can further be transformed into "$\Pi\{h/\sqrt{3}\}^2$".

Here, the ratio of both "S2/S1" can be shown with "$\Pi(h/\sqrt{3})^2/\pi r^2$". The height of ink pillar 264 is around six to ten times of the opening diameter d, and can averagely be considered to be around eight times. Therefore, assuming that the radius of opening 262 is "1" and the height h of ink pillar 264 is "8", the area ratio "S2/S1" becomes "85.3". This means that electric charges accumulated in a droplet by a lightning conductor effect extend to 85.3 times of electric charges accumulated when only a horizontal cross section of the ink pillar 264 is contributed to electrification.

Further, Coulomb force F acting on a droplet charged with the electric charge q in the electric field E can be shown with "qE". At this time, assuming that an applied voltage is "V", a distance between the nozzle plate 260 and the electrode 430 is "D", and a dielectric constant is "$\epsilon$", Coulomb force F is about "q(V/D)". When the area S contributing to electrification is added to the force, Coulomb force F becomes "$\epsilon S(V^2/D^2)$", and can further be shown with "$\epsilon SE^2$". From this, Coulomb force F is proportional to a contribution area S, and thus it is found that the force F is proportional to the square of an electric field E. In other words, when the contribution area varies from $S_1$ to $S_2$, an electric field E0 necessary to apply the same Coulomb force F as that before the change of area to a droplet charged with the electric charge q can be shown with "$E\cdot\sqrt{(S_2/S_1)}$".

When the expression is applied to an ink pillar having the height h of eight times of the above opening diameter d, it is enough that an electric field E necessary to obtain the same Coulomb force is "$1/\sqrt{(85.3)}$". Further, when this is applied to a numeric value disclosed in Japanese Patent Application Publication No. 2004-202867, a liquid ejecting apparatus disclosed in the Publication forms an electric field of 1 MV/m in order to obtain an effective electric field. On the contrary, a liquid ejecting apparatus according to this embodiment can acquire the same effect in an electric field of the degree of 110 kV/m.

In addition, as found from the description, when there increases the height of ink pillar 264 formed on the surface of nozzle plate 260 at the moment just before the droplet 266 is discharged, the electric charge q charged in the droplet formed from the pillar also becomes large. If the electric charge q electrified in the droplet 266 becomes larger since Coulomb force Fe (qE) acting on the droplet 266 from an electric field E also becomes large, the applied electric field E necessary to obtain a constant effect can be reduced still more.

Figure 7:
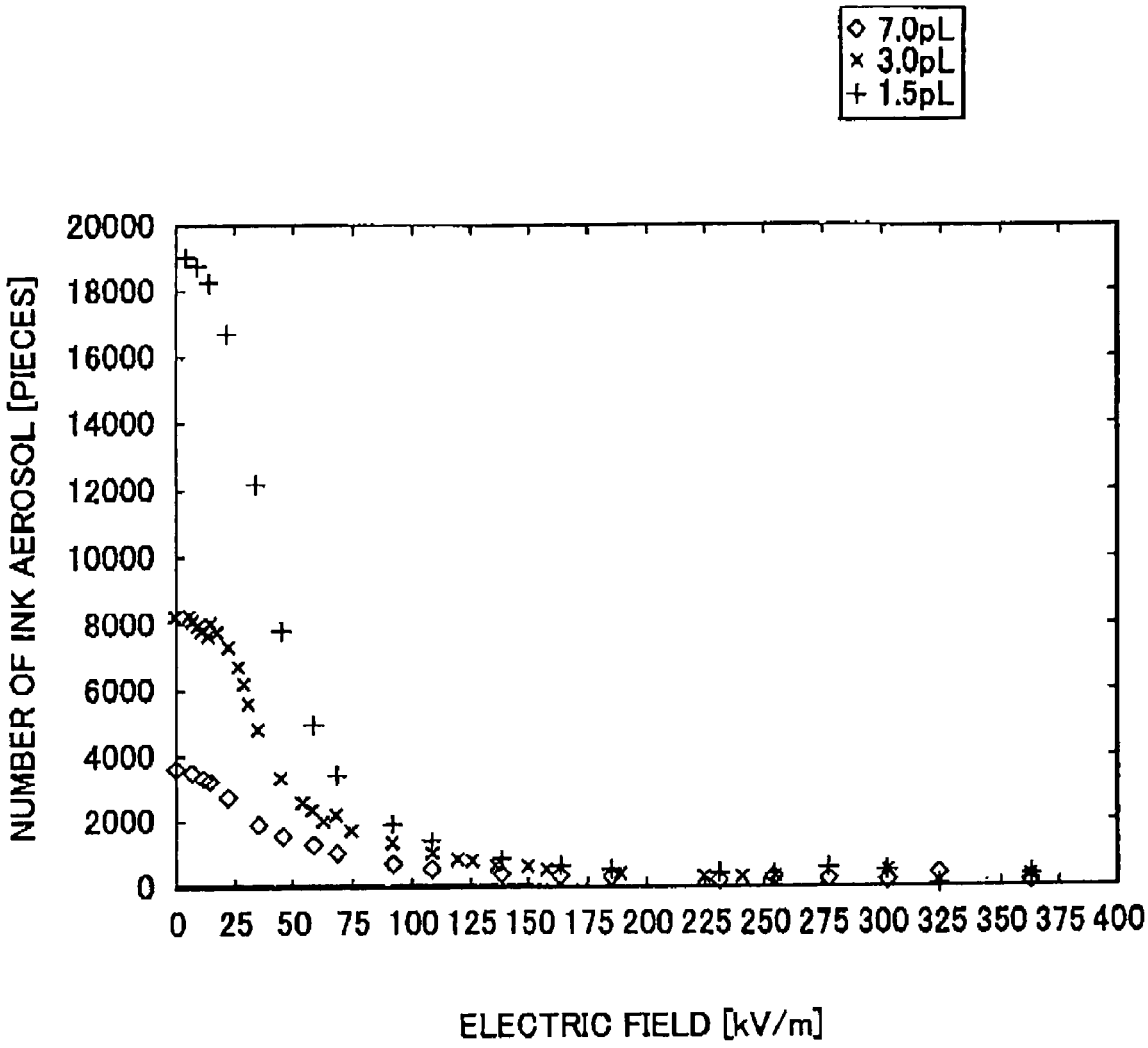
FIG. 7 is a graphic chart showing relation between an applied electric field and the number of aerosols in an embodiment.

FIG. 7 is a graphic chart showing relation between the applied electric field and the number of floating aerosols in an embodiment of the ink-jet type recording apparatus 11 as described above. That is, a recording operation is performed after forming an electric field with various intensities between the nozzle plate 260 and the electrode 430, and the drawing has been plotted by measuring a floating amount of aerosols generated according to this. When measuring the amount, the recording operation has been performed on A4-size five pieces of recording material according to the magnitude of droplet each having particle size of 1.5 pl, 3 pl, and 7 pl for seven minutes 38 seconds from the start of printing, and the result obtained by dividing the total number of aerosols capable of being counted till eight minutes pass after the start of printing by eight becomes the number of aerosols per one minute.

As shown in the present drawing, the number of aerosols begins to decrease conspicuously when an electric field exceeds 25 kV/m compared with when an electric field does not exist at all. Further, when an electric field exceeds 80 kV/m, the number of aerosols becomes around 1000 to 2000 regardless of the size and it is found that aerosols have fully been collected.

Figure 8:
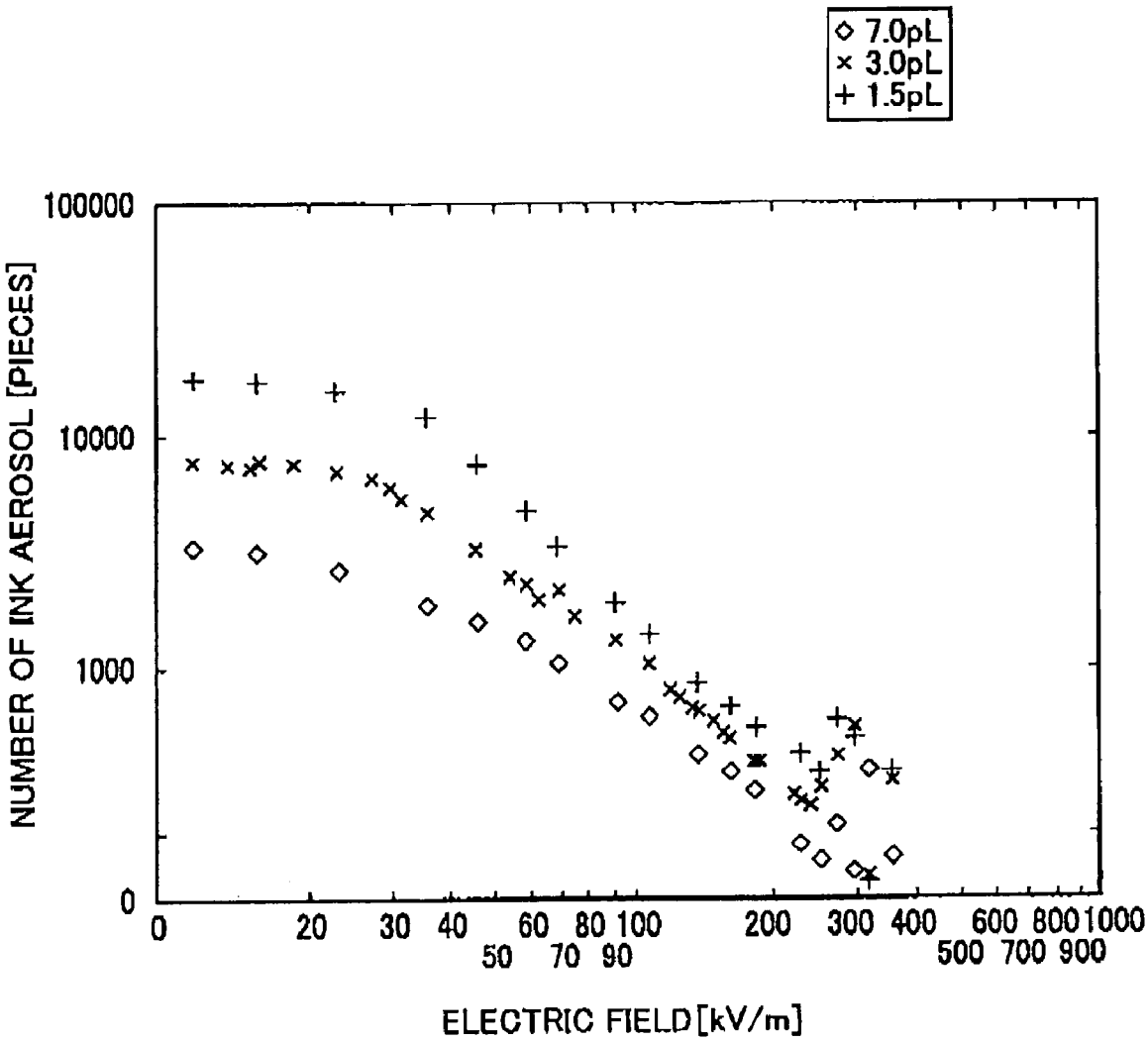
FIG. 8 is a graphic chart showing a logarithmic display for the number of aerosols in the graphic chart shown in FIG. 7.

FIG. 8 is a graphic chart showing a logarithmic display of the number of aerosols (a vertical axis) and the applied voltage (a horizontal axis) in the graphic chart shown in FIG. 7. As found from the present invention, the number of aerosols continues to be reduced even when the applied electric field is set to more than 80 kV/m. However, in an area of the applied electric field exceeding 250 kV/m, since the degree of reduction has disarray, linearity of aerosol reduction for the applied electric field is lost, and thus it is found that there is not difference in view of an effect even if the electric field is raised. In this way, it is preferable that an electric field is not less than 25 kV/m and not more than 250 kV/m.

Here, in the ink-jet type recording apparatus 11 shown in FIGS. 1 and 2, ink adheres to the absorbing member 420 as operating time passes. In this state, when the absorbing member 420 comes in contact with the recording material 300, the recording material 300 is contaminated by ink. Thus, since a protrusion-shaped part is formed on a top face of the platen 400 to support the recording material 300 from the lower side, the interval between both is kept to prevent contact.

Moreover, since the material of absorbing member 420 included in the platen 400 is selected in serious consideration of absorption velocity of ink on a surface thereof, an absorption capacity has limitation. Thus, the ink-jet type recording apparatus 11 further includes a larger waste liquid absorbing member 600 on the lower side of the platen 400, and the waste liquid absorbing member 600 is in contact with the absorbing member 420 partially. As the material of the waste liquid absorbing member 600, there is selected a material having large absorbing power by an absorption capacity and a capillary phenomenon. Therefore, the waste liquid absorbing member 600 can absorb a large quantity of ink from the absorbing member 420.

Figure 9:
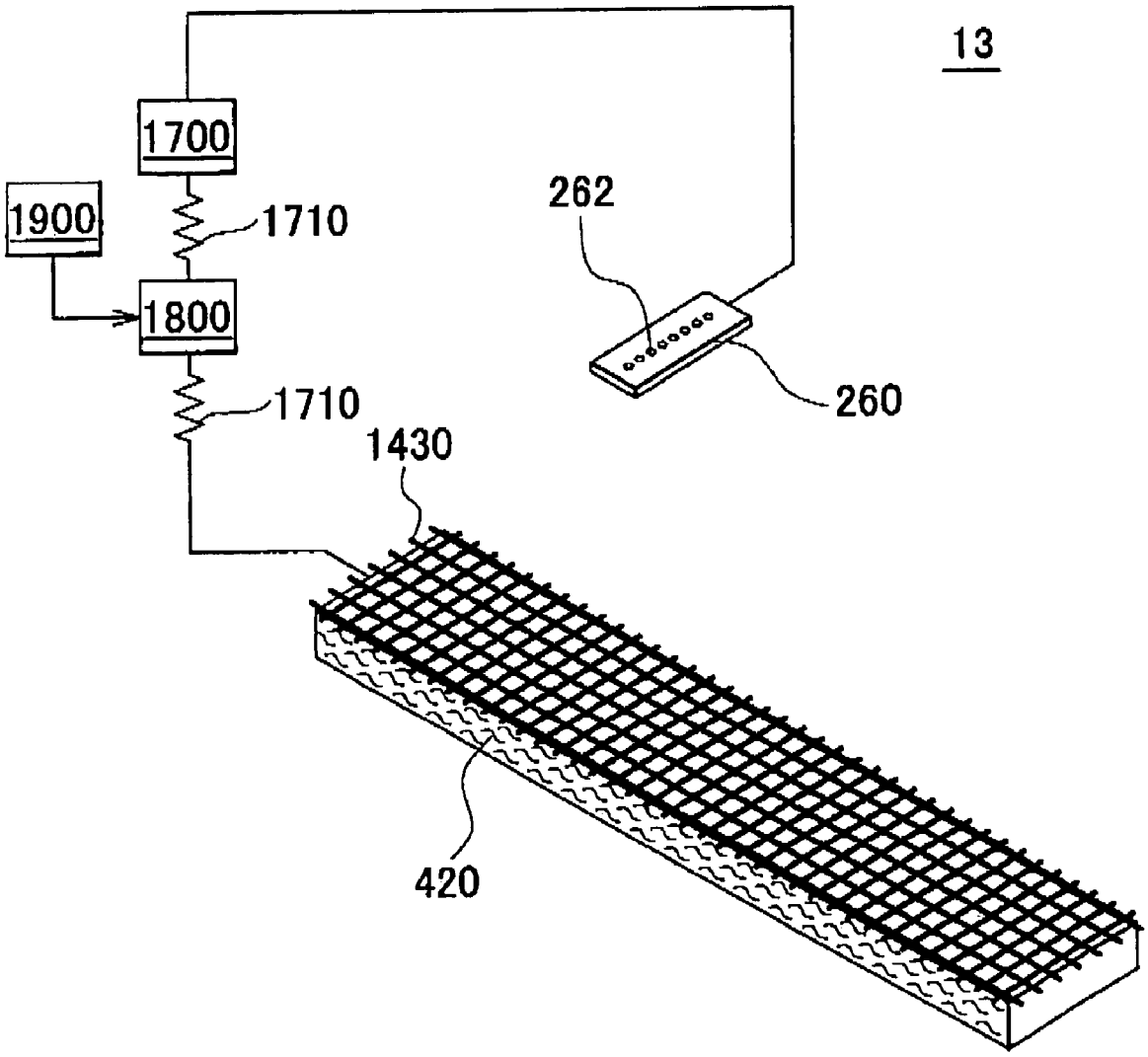
FIG. 9 is an exploded perspective view showing a satellite ink collecting mechanism of an ejecting apparatus shown in FIG. 1.

FIG. 9 is an exploded perspective view showing a satellite ink collecting mechanism 13 in the ink-jet type recording apparatus 11 shown in FIG. 1. Moreover, FIG. 9 also shows relation between a recording material side electrode 1430 and the nozzle plate 260.

As shown in the present drawing, one end of a voltage generating means 1700 is connected to the nozzle plate 260 A plurality of openings 262 is formed on the nozzle plate 260, and ink is discharged from these openings. On the other hand, the other end of the voltage generating means 1700 is connected to a recording material side electrode 1430 arranged on the absorbing member 420 via a pair of protective resistors 1710 and a voltage stopping means 1800 held between these protective resistors 1710. Here, the voltage stopping means 1800 is controlled by a stop signal generated from an opening and closing detecting section 1900.

In addition, the recording material side electrode 1430 as described above can be formed of metal with corrosion resistance against ink of the ink-jet type recording apparatus 11 for example, wire rod, plate, or foil material of gold, stainless steel, or nickel, or wire rod, plate, or foil material plated with these metals, or a net-like or lattice-like member made by combining these materials. On the other hand, the absorbing member 420 can use resin foaming material such as polyethylene and polyurethane.

Moreover, when the voltage stopping means 1800 receives a stop signal, the voltage stopping means 1800 blocks electric conduction between a pair of protective resistors 1710. Therefore, a voltage formed by the voltage generating means 1700 between the nozzle plate 260 and the recording material side electrode 1430 is also canceled. In addition, such a voltage stopping means 1800 can be realized with a device or an element such as a relay and a semiconductor switch for opening a circuit by a control signal (a stop signal). Moreover, since an operation of these device and element is reversible, stopping the stop signal is sufficient to resume the voltage generation.

Further, the opening and closing detecting section 1900 generates a stop signal when a case of the ink-jet type recording apparatus 11 is opened. Such an opening and closing detecting section 1900 can be realized with various kinds of forms, e.g., a combination of a mechanical switch, a semiconductor switch, a light source, and an optical sensor, a combination of a permanent magnet and a hall element, and so on. Since an operation of these device and element is reversible, these device and element can be used as a means for detecting whether the case is closed in addition to a means for detecting whether the case is opened.

Moreover, each short protection resistor 1710 prevents excessive currents from flowing between the nozzle plate 260 and the recording material side electrode 1430 when a short breaks out between the nozzle plate 260 and the recording material side electrode 1430 due to some sort of reasons. Such a short circuit may break out when the recording material 300 or the like is jammed between the nozzle plate 260 and the platen 400 or when a thing or a hand is carelessly put inside the ink-jet type recording apparatus 11. In addition, the short protection resistor 1710 may be a pair of resistors on both sides of the voltage stopping means 1800, or either of one resistor between the voltage generating means 1700 and the voltage stopping means 1800 or one resistor between the recording material side electrode 1430 and the voltage stopping means 1800.

In the ink-jet type recording apparatus 11 as described above, an electric field is formed between the nozzle plate 260 and the recording material side electrode 1430 when a recording operation is performed. Moreover, since ink discharged from the nozzle plate 260 is charged with electricity having the same polarity as that of the nozzle plate 260, the ink is forced by Coulomb force from an electric field so as to accelerate toward the recording material side electrode 1430 having reverse polarity. Therefore, the ink not attached to the recording material 300 is attracted to the recording material side electrode 1430, and is absorbed into the absorbing member 420 before long.

Further, when accessing the inside of ink-jet type recording apparatus 11, the top case 22 is first opened. Thus, the opening and closing detecting section 1900 detects the opening of top case 22, and outputs a stop signal to the voltage stopping means 1800. Since the voltage stopping means 1800 that has received the stop signal blocks electric conduction between the recording material side electrode 1430 and the voltage generating means 1700, an electric current does not flow even when a hand of a user touches the recording material side electrode 1430, and thus an electric shock can be prevented. In addition, it can further be constituted to detect the closing of the top case 22 and resume the application of a voltage.

Moreover, it has been described that the opening and closing detecting section 1900 detects that the top case 22 is opened. However, by the model of the liquid ejecting apparatus, there may be another opening and closing section by which a hand can be put inside the apparatus. That is, there are the case when some apparatuses separately include the top case 22 for removing the jammed recording material 300 and a lid for changing the ink cartridge 250, the case when an operating section for changing a part of printing conditions (the thickness of recording material 300 or the like) is provided in the case, the case when an opening and closing cover for repairing the inside of the liquid ejecting apparatus is provided, and so on. Moreover, an opening and closing lid for charging the recording material 300 with a specific shape may separately be provided. In these cases, the apparatus may include an opening and closing detecting section for detecting the opening of the lid, the cover, the case, and so on, and stop applying a voltage when the opening of either of them is detected.

Figure 10:
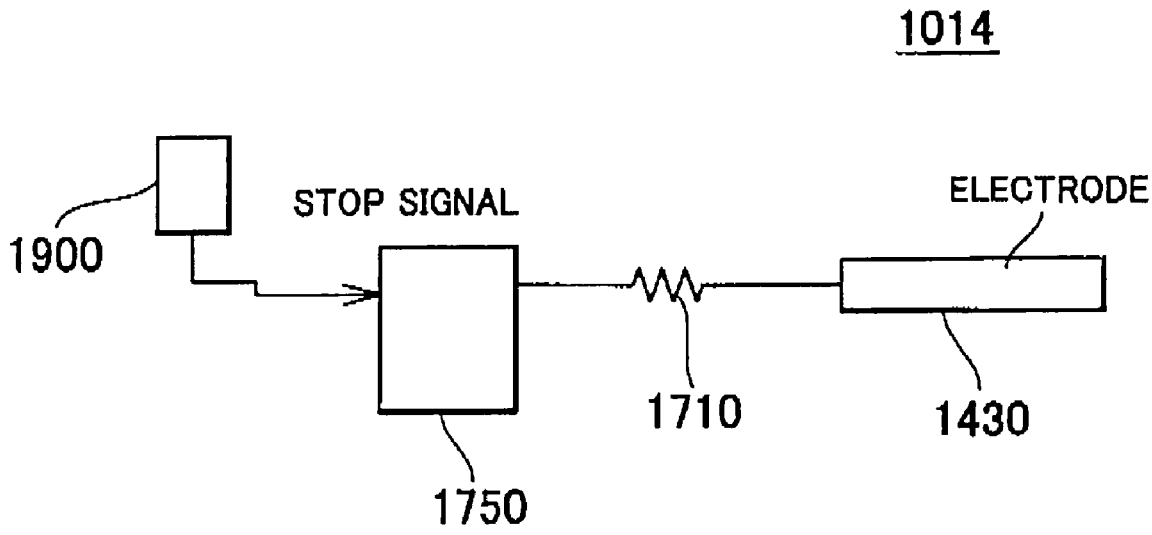
FIG. 10 is a block diagram showing an embodiment of a voltage stopping means.

FIG. 10 is a block diagram showing another embodiment of the voltage stopping means 1014 in the ink-jet type recording apparatus 11. In the present drawing, circuits from the voltage generating means 1750 to the nozzle plate 260 are not shown In this embodiment, the voltage generating means 1750 is coupled with the recording material side electrode 1430 via the protective resistor 1710. Moreover, the stop signal that is an output from the opening and closing detecting section 1900 is directly input into the voltage generating means 1750.

In the embodiment already shown in FIG. 9, the voltage stopping means 1800 blocks electric conduction between the voltage generating means 1750 and the recording material side electrode 1430 to stop applying a voltage to the recording material side electrode 1430. On the contrary, in an embodiment shown in FIG. 10, an operation of the voltage generating means 1750 is stopped according to a stop signal generated from the opening and closing detecting section 1900. In this way, since a voltage source disappears, a voltage to be applied to the recording material side electrode 1430 also disappears. In addition, the voltage generating means 1750 employed in this embodiment in itself includes a function for stopping an operation according to a control signal.

Figure 11:
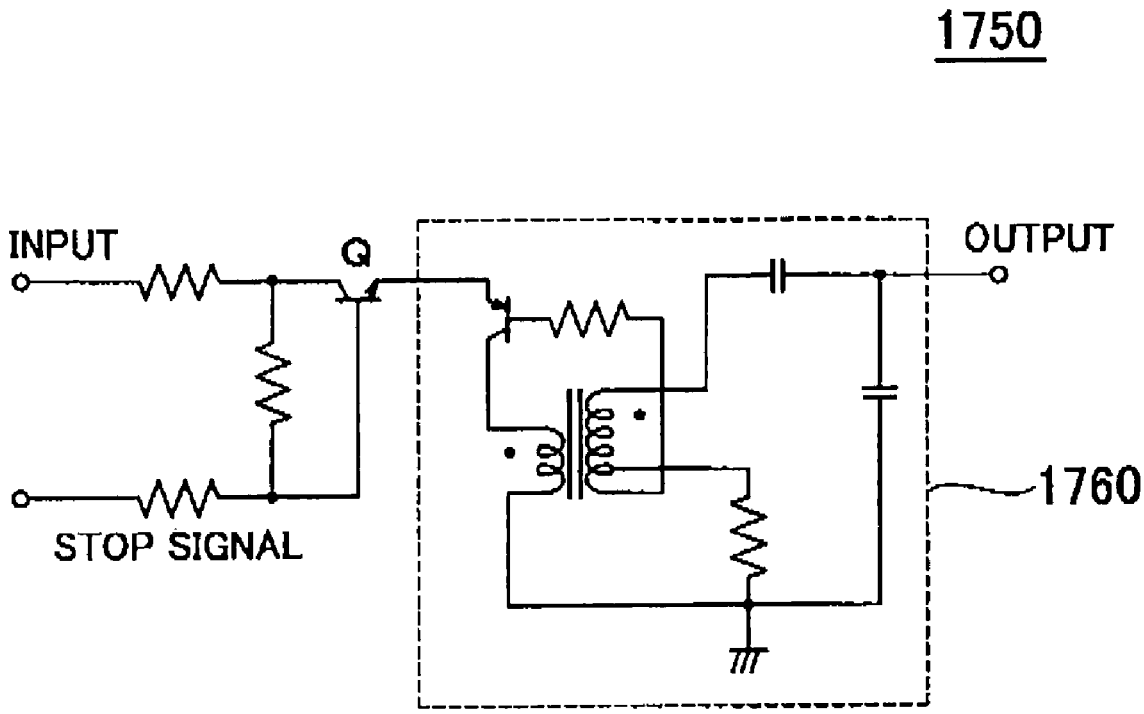
FIG. 11 is a circuit diagram exemplary showing a voltage generating means that can be used in an embodiment according to FIG. 10.

FIG. 11 is a view showing an embodiment of the voltage generating means 1750 including therein the voltage stopping means 1800 that may be used in an embodiment according to FIG. 10. As shown in the present drawing, this voltage generating means 1750 includes a self-excitation type pressor voltage source circuit 1760 and a transistor Q of which one end is connected to an input of the whole of the voltage generating means 1750, the other end is connected to an input terminal of the voltage source circuit 1760, and a control terminal receives a stop signal. Since the transistor Q does not flow electric currents when its control terminal receives a stop signal, an output voltage of the whole of the voltage generating means 1750 also disappears.

Figure 12:
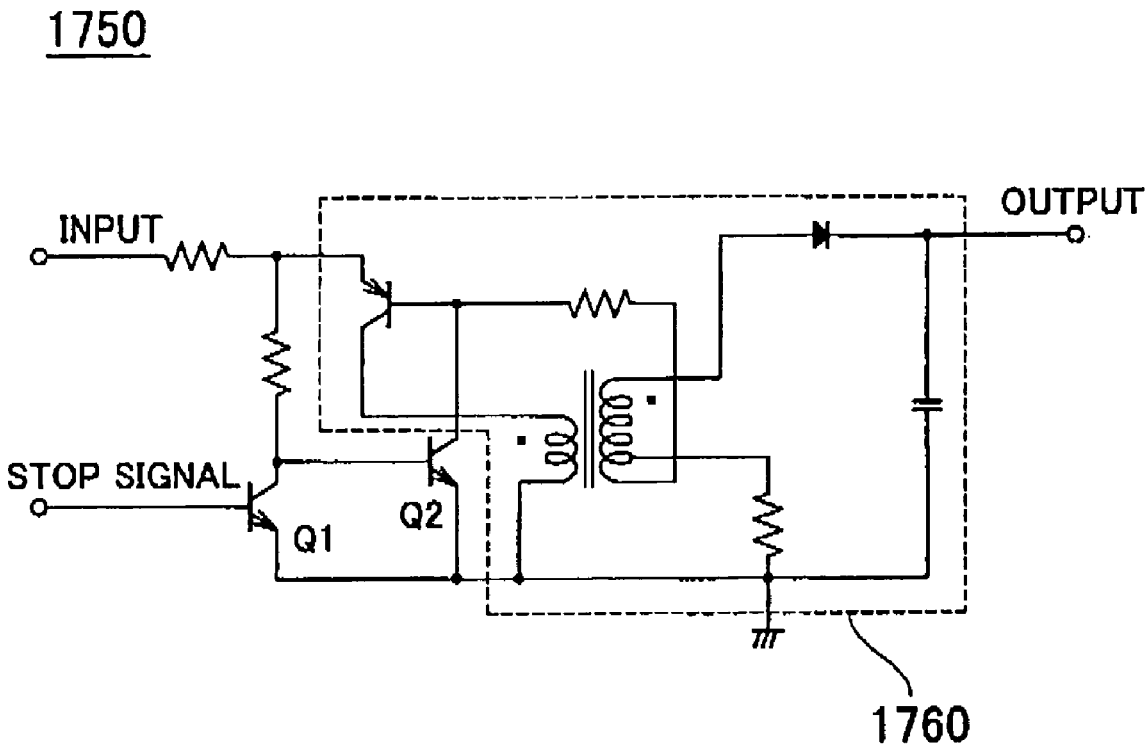
FIG. 12 is a circuit diagram exemplary showing a voltage generating means that can be used in an embodiment according to FIG. 10.

FIG. 12 is a view showing an embodiment of the voltage generating means 1750 including therein the voltage stopping means 1800 that may be used in an embodiment according to FIG. 10. As shown in the present drawing, this voltage generating means 1750 includes a self-excitation type pressor voltage source circuit 1760 and a pair of transistors $Q_1$ and $Q_2$. Here, in the transistor $Q_1$, one end is connected to an input of the whole of the voltage generating means 1750, the other end is connected to ground, and a control terminal receives a stop signal. Moreover, in the transistor $Q_2$, one end is connected to a feedback circuit of the voltage source circuit 1760, the other end is connected to ground, and a control terminal is coupled between the input of the whole of the voltage generating means 1750 and one end of the transistor $Q_1$. Since electric currents do not flow between both terminals of the transistor $Q_1$ when a stop signal is applied to this circuit, an input voltage is applied to the control terminal of the transistor $Q_2$, and thus electric currents flow between both terminals. For this reason, a transistor inside the voltage source circuit 1760 is bypassed not to operate as a voltage source.

Figure 13:
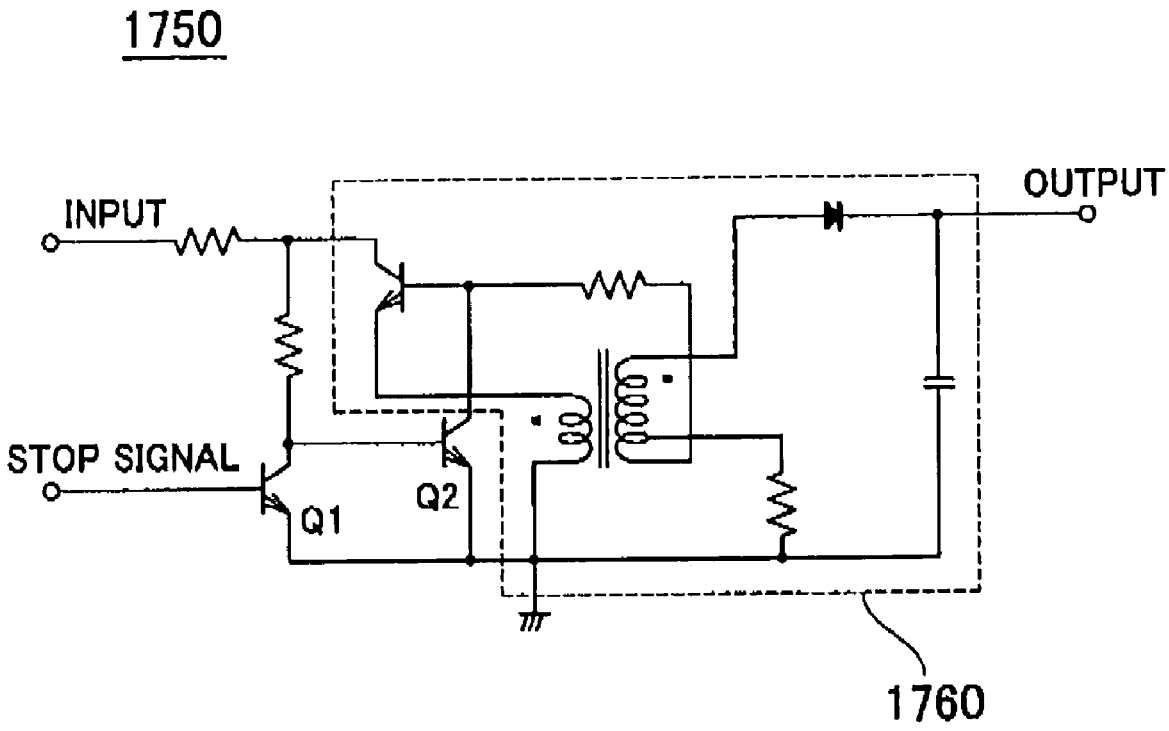
FIG. 13 is a circuit diagram exemplary showing a voltage generating means that can be used in an embodiment according to FIG. 10.

FIG. 13 shows an alternative example of the voltage generating means 1750 shown in FIG. 12. In the voltage generating means 1750, the polarity of the transistor included in the voltage source circuit 1760 is different, and thus the generating means of the alternative example has the same configuration and function as those of the voltage generating means shown in FIG. 12 except for the difference of connection of a secondary side of a transformer.

Figure 14:
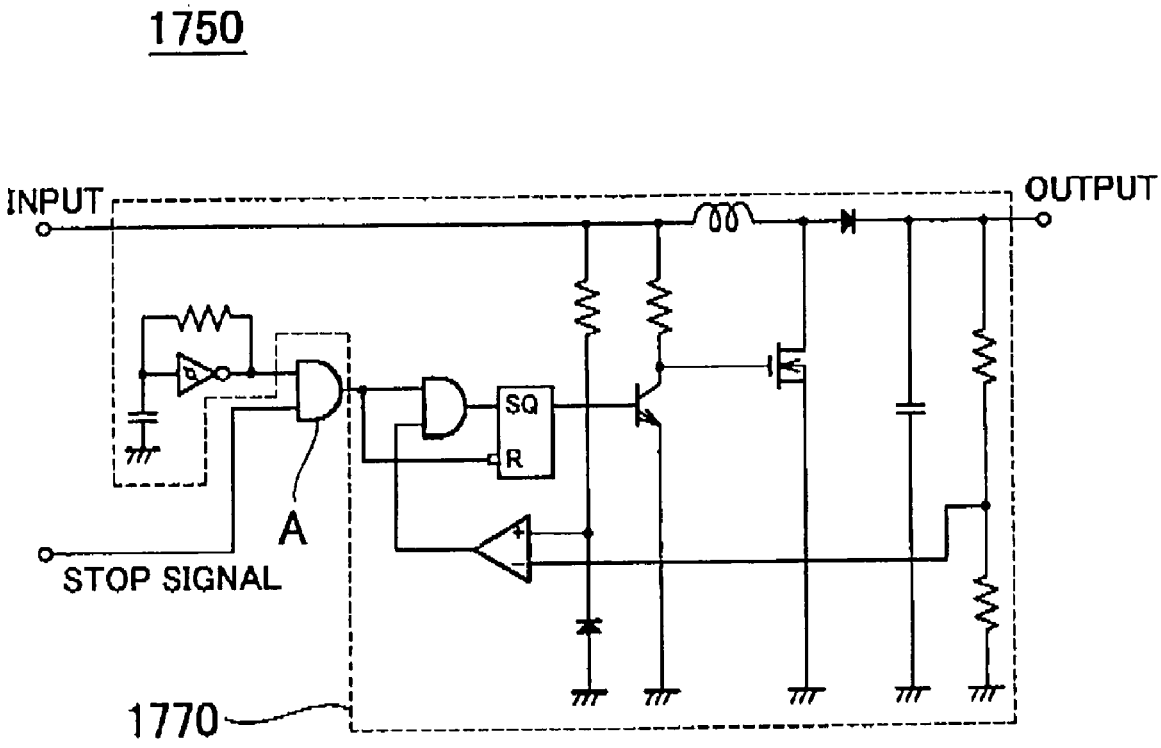
FIG. 14 is a circuit diagram exemplary showing a voltage generating means that can be used in an embodiment according to FIG. 10.

FIG. 14 is a view showing another embodiment of the voltage generating means 1750 including therein the voltage stopping means 1800 that may be used in an embodiment according to FIG. 10. As shown in the present drawing, in this voltage generating means 1750, an AND gate A is connected to an output of an oscillator in a separately-excited chopper type pressor voltage source circuit 1770 and a stop signal is connected to one input of the AND gate. For this reason, when a stop signal is generated, since the output of AND gate A is fixed regardless of an output state of the oscillator and a state of a flip-flop does not transit, the generating means 1750 does not operate as the voltage source circuit 1770.

Figure 15:
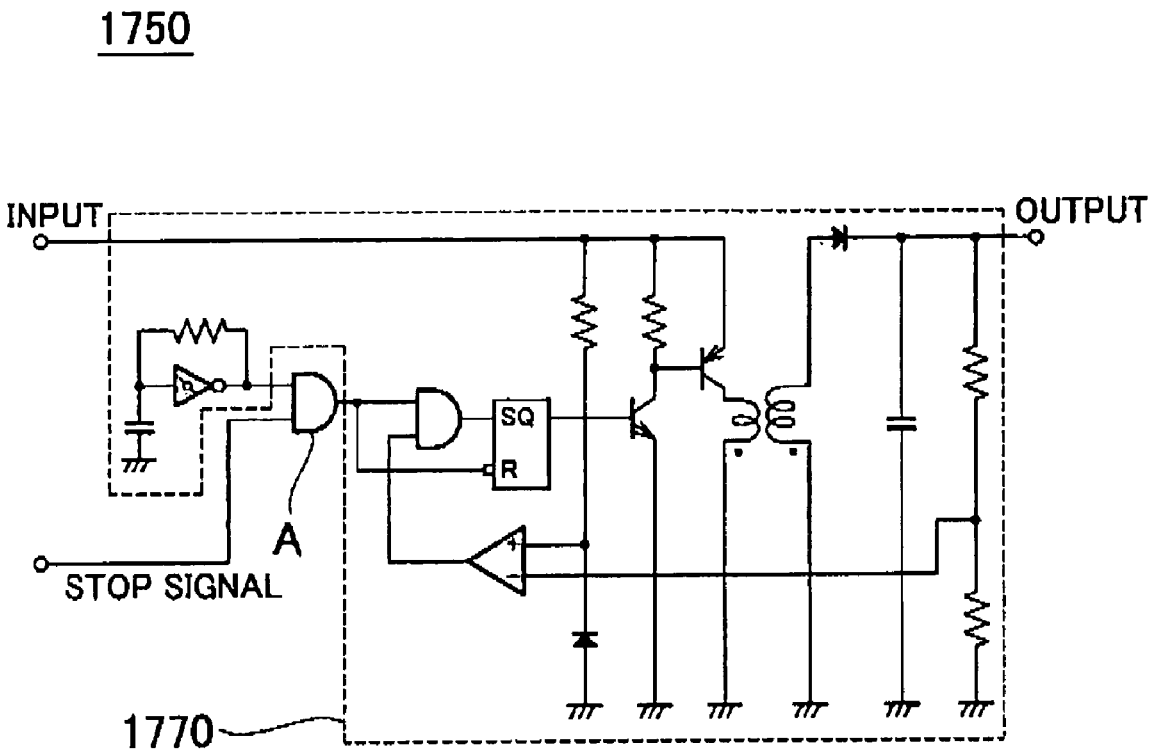
FIG. 15 is a circuit diagram exemplary showing a voltage generating means that can be used in an embodiment according to FIG. 10.

FIG. 15 is an alternative example of an embodiment shown in FIG. 14. Here, an AND gate A is connected to the output of the oscillator of the separate-excitation type pressor voltage source circuit 1770 and a stop signal is connected to an input of one side of the AND gate A. That is, since the voltage generating means 1750 of this embodiment has the same configuration and function as those of the circuit shown in FIG. 14 except that the configuration of the voltage source circuit 1770 is a separate-excitation pressor type, an operation as the voltage generating means 1750 can be stopped by applying a stop signal.

Figure 16:
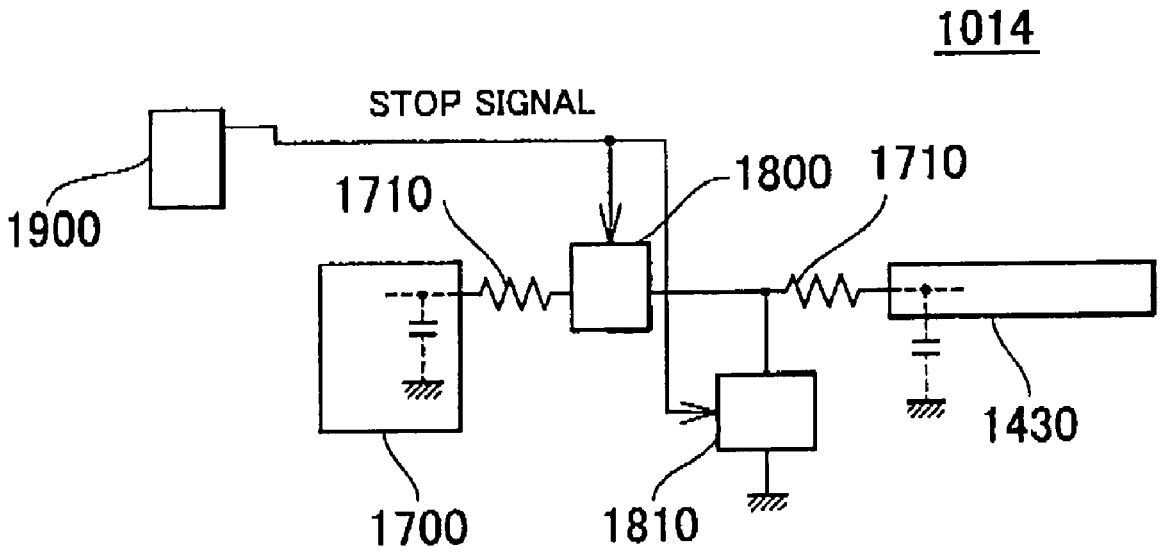
FIG. 16 is a block diagram showing another embodiment of a voltage stopping means.

FIG. 16 shows a block diagram showing further another embodiment of the voltage stopping means 1014. Similarly to the case of FIG. 10, circuits from the voltage generating means 1700 to the nozzle plate 260 are not shown.

That is, this voltage stopping means 1014 adds a charge discharging means 1810 to the satellite ink collecting mechanism 13 shown in FIG. 9. One end of the charge discharging means 1810 is connected to the recording material side electrode 1430 via the protective resistor 1710, and the other end is grounded. Moreover, the charge discharging means 1810 can receive a stop signal output from the opening and closing detecting section 1900. Since the charge discharging means 1810 that has received a stop signal streams electric currents between both ends, the recording material side electrode 1430 is connected to ground via the protective resistor 1710. In addition, the charge discharging means 1810 opens the circuit to block connection between the recording material side electrode 1430 and the ground when the stop signal has not been received.

In the voltage stopping means 1014 configured as above, when the opening and closing detecting section 1900 generates a stop signal, a voltage stopping means 1800 that has received it opens the circuit to block an output from the voltage generating means 1700. Moreover, the charge discharging means 1810 also receives the stop signal to closes the circuit, and thus makes the recording material side electrode 1430 to be connected to ground. Therefore, electric charges generated and accumulated by an electrostatic capacity between the recording material side electrode 1430 and the outside are discharged through the protective resistor 1710, and thus electric currents do not flow at all even if a user touches the recording material side electrode 1430. That is, an electric circuit such as the voltage generating means 1700 generally has internal impedance, and thus electric charges according to each electrostatic capacity remain behind even after an operation is stopped. Therefore, in such a state, when a thing having an electric potential different from that of the recording material side electrode 1430 touches the electrode 1430, electric currents may flow between both. In addition, a relay, a transistor, and so on can be used as the charge discharging means 1810.

Figure 17:
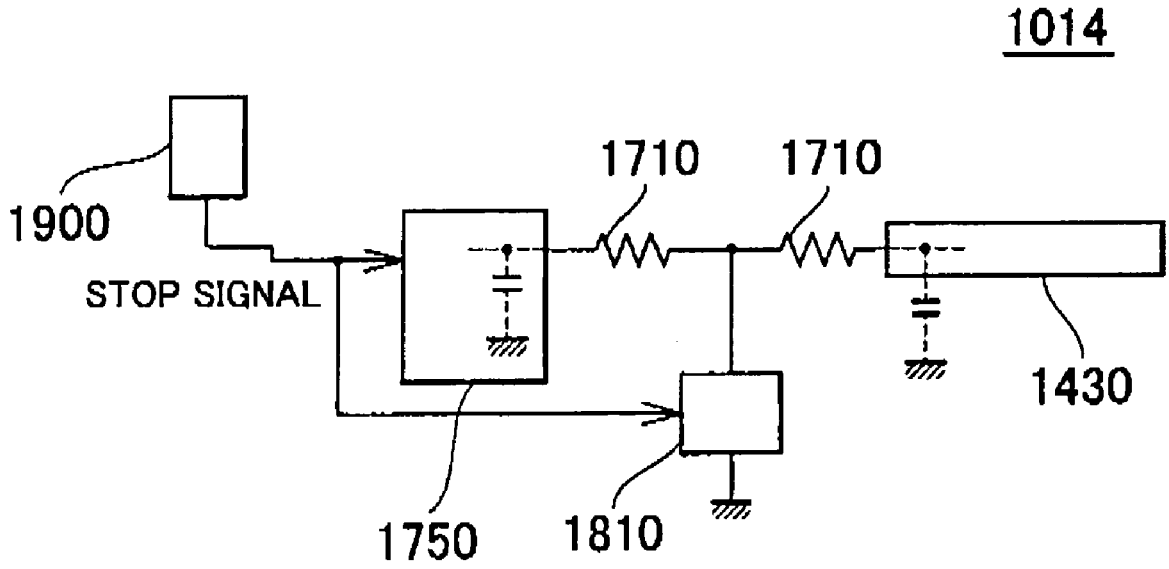
FIG. 17 is a block diagram showing another embodiment of a voltage stopping means.

FIG. 17 is a block diagram showing a form of the voltage stopping means 1014 made by adding the charge discharging means 1810 to an embodiment shown in FIG. 10. Similarly to the case of FIG. 10, circuits from the voltage generating means 1750 to the nozzle plate 260 are not shown. That is, in this embodiment, the charge discharging means 1810, which is inserted between a middle point between a pair of protective resistors 1710 and ground, is added to the voltage stopping means 1014 shown in FIG. 10. Moreover, the charge discharging means 1810 can receive a stop signal output from the opening and closing detecting section 1900. Since the charge discharging means 1810 that has received a stop signal streams electric currents between both ends, the recording material side electrode 1430 is coupled with the ground via the protective resistor 1710. The charge discharging means 1810 opens the circuit to block connection between the recording material side electrode 1430 and the ground when the stop signal is not received.

In the voltage stopping means 1014 configured as above, when the opening and closing detecting section 1900 generates a stop signal, the voltage generating means 1700 that receives it stops an operation, and thus a voltage is not applied to the recording material side electrode 1430. Moreover, the charge discharging means 1810 also receives the stop signal, and closes the circuit to connect the middle point of the protective resistor 1710 to the ground. Therefore, both of the recording material side electrode 1430 and the voltage generating means 1750 are respectively connected to the ground via the protective resistor 1710, and thus electric charges are respectively discharged from both.

Figure 18:
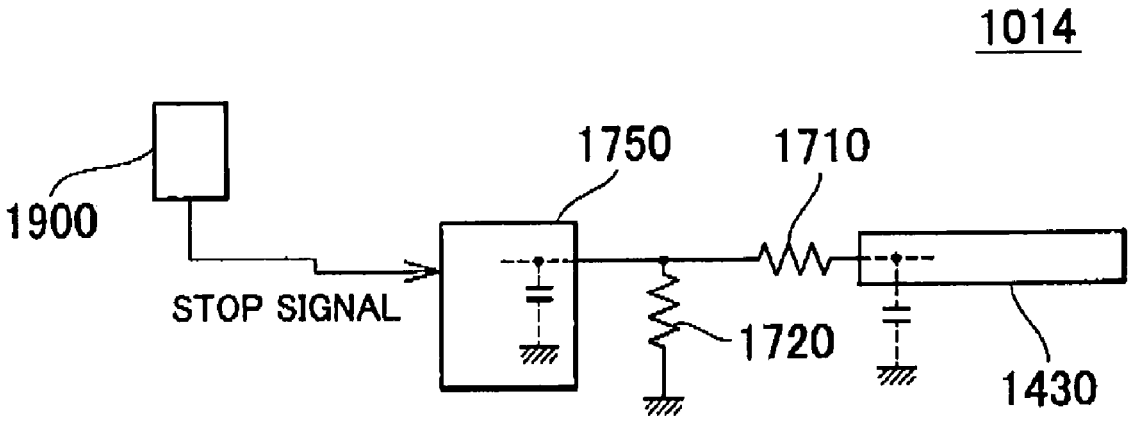
FIG. 18 is a block diagram showing another embodiment of a voltage stopping means.

FIG. 18 shows an alternative example of an embodiment of the voltage stopping means 1014 shown in FIG. 17. As shown in the present drawing, in this embodiment, the voltage generating means 1750 stops an operation by a top signal generated from the opening and closing detecting section 1900. Moreover, a discharge resistor 1720 is used instead of the charge discharging means 1810, and is provided between one end of the protective resistor 1710 and the ground to couple them with each other. Here, the resistance value of the discharge resistor 1720 is significantly large in comparison with the resistance value of the protective resistor 1710, and thus electric currents does not mostly flow into the discharge resistor 1720 usually. On the other hand, when the opening and closing detecting section 1900 generates a stop signal to stop an operation of the voltage generating means 1700, all of electric charges accumulated in the voltage generating means 1700 and electric charges accumulated in the recording material side electrode 1430 are discharged to the ground via the discharge resistor 1720.

Figure 19:
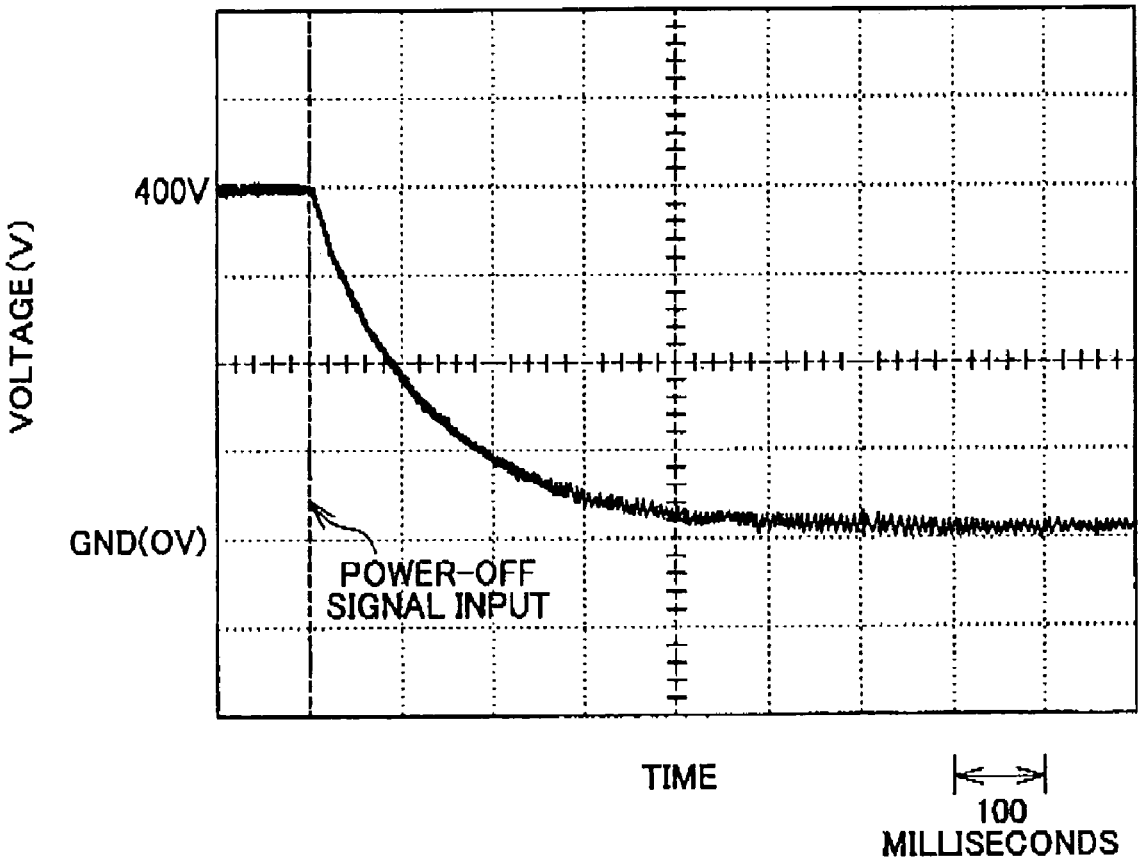
FIG. 19 is a view showing the result obtained by measuring a transition of an electrode voltage just after generating a stop signal.

FIG. 19 is a view showing an oscilloscope waveform obtained by measuring a transition of a voltage on the recording material side electrode 1430 just after a stop signal has been generated, in the ink-jet type recording apparatus 11 including a discharge function shown in FIG. 18. As shown in the present drawing, a voltage falls to 40 volts after 310 msec from the generation of stop signal, and further falls to 0 volt after 600 msec. Considering that about 500 msec is time required from a point of time at which a user opens the case of the recording apparatus to a point of time when the user puts his/her hand in the case, it is confirmed that the voltage sufficiently falls when the user touches the inside of the recording apparatus.

Figure 20:
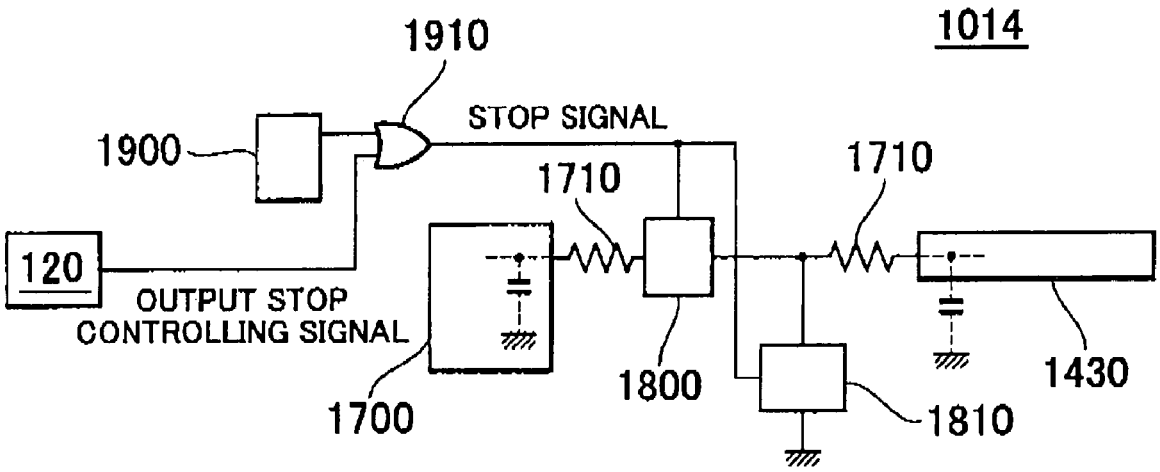
FIG. 20 is a block diagram showing another embodiment of a voltage stopping means.

However, the electronic circuit 120 for comprehensively controlling various kinds of functions is implemented in the ink-jet type recording apparatus 11. When detecting some kind of failures such as lack and conveyance failure of the recording material 300 and exhaustion of ink, the electronic circuit 120 issues an error message and also generates an output stop controlling signal to stop a recording operation. Since a possibility of a user putting his/her hand in the ink-jet type recording apparatus 11 is extremely high when such a failure occurs, safety of the ink-jet type recording apparatus 11 can more be improved by adding a function for stopping the generation of a voltage when a failure occurs, FIG. 20 is a view showing an embodiment adding a control function by an output stop controlling signal to the voltage stopping means 1014 already shown in FIG. 16. That is, in the voltage stopping means 1014, the output from the opening and closing detecting section 1900 in a configuration shown in FIG. 16 is connected to one input of an OR circuit 1910 introduced in this embodiment. Moreover, an output stop controlling signal supplied from the electronic circuit 120 for controlling the whole of the ink-jet type recording apparatus 11 is input into the other input of the OR circuit 1910. Further, the output of the OR circuit 1910 is supplied as a stop signal to the voltage stopping means 1800 and the charge discharging means 1810.

In the voltage stopping means 1014 configured as described above, when at least one of the output signal from the opening and closing detecting section 1900 and the output stop controlling signal by the electronic circuit 120 is generated, the OR circuit 1910 outputs a stop signal, and the voltage stopping means 1800 that receives it opens the circuit to block the output of the voltage generating means 1700. Moreover, the charge discharging means 1810 closes the circuit to connect the recording material side electrode 1430 to ground. Therefore, a voltage applied to the recording material side electrode 1430 is stopped and electric charges generated and accumulated by an electrostatic capacity between the recording material side electrode 1430 and the outside are discharged through the protective resistor 1710, and thus electric currents do not flow at all even if a user touches the recording material side electrode 1430. In addition, the electronic circuit 120 may be configured to generate an output stop controlling signal also when an operation of the ink-jet type recording apparatus 11 has not been executed more than a certain fixed period. In such a case, since the voltage stopping means 1014 also stops generating a voltage, this contributes to the improvement of safety and the saving of electric power still more.

Figure 21:
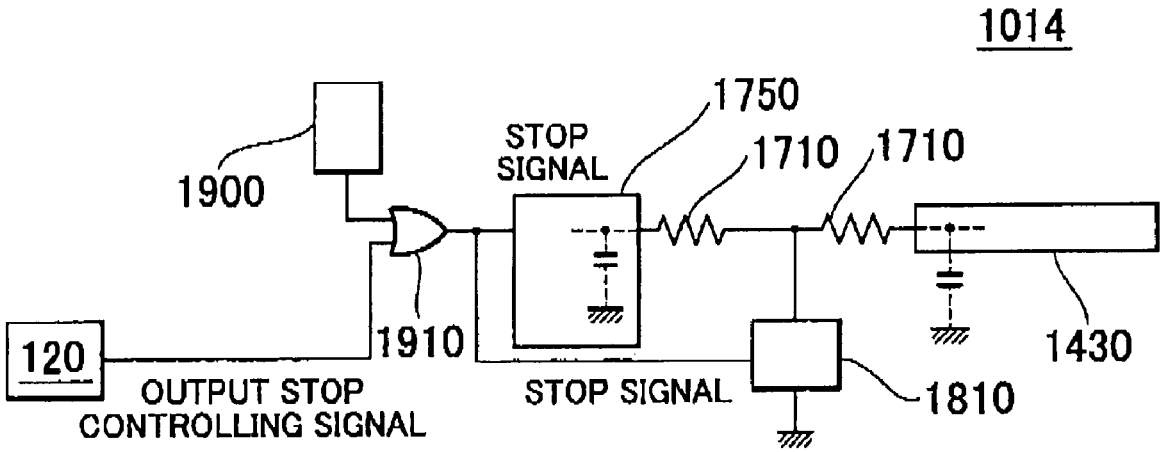
FIG. 21 is a block diagram showing another embodiment of a voltage stopping means.

FIG. 21 is a view showing an embodiment adding a control function by an output stop controlling signal to the voltage stopping means 1014 shown in FIG. 17. That is, in the voltage stopping means 1014, a signal output from the opening and closing detecting section 1900 in a configuration shown in FIG. 17 is connected to one input of the OR circuit 1910. Moreover, an output stop controlling signal supplied from the electronic circuit 1120 for controlling the whole of the ink-jet type recording apparatus 11 is input into the other input of the OR circuit 1910. Further, the output of the OR circuit 1910 is supplied as a stop signal to the voltage generating means 1750 and the charge discharging means 1810.

In the voltage stopping means 1014 configured as described above, when at least one of the output signal from the opening and closing detecting section 1900 and the output stop controlling signal by the electronic circuit 120 is generated, since the OR circuit 1910 that receives it generates a stop signal, the voltage generating means 1750 stops an operation and thus a voltage applied to the recording material side electrode 1430 is stopped. Moreover, when the charge discharging means 1810 receives a stop signal, the charge discharging means 1810 closes the circuit to connect the middle point of protective resistor 1710 to ground. Therefore, both of the recording material side electrode 1430 and the voltage generating means 1750 are respectively connected to ground via the protective resistor 1710, and electric charges each accumulated are discharged.

Figure 22:
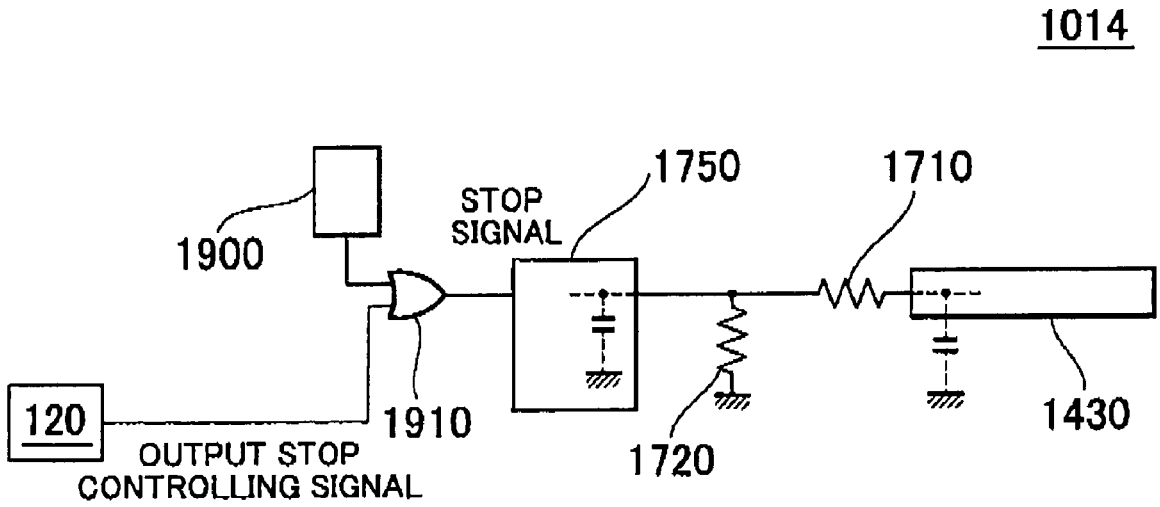
FIG. 22 is a block diagram showing another embodiment of a voltage stopping means.

FIG. 22 is a view showing an embodiment adding a control function by an output stop controlling signal as described above to the voltage stopping means 1014 shown in FIG. 18. That is, in the voltage stopping means 1014, the output from the opening and closing detecting section 1900 in a configuration shown in FIG. 18 is connected to one input of the OR circuit 1910. Moreover, an output stop controlling signal supplied from the electronic circuit 120 for controlling the whole of the ink-jet type recording apparatus 11 is input into the other input of the OR circuit 1910. Further, the output of the OR circuit 1910 is supplied as a stop signal to the voltage generating means 1750.

In the voltage stopping means 1014 configured as described above, when at least one of the output signal from the opening and closing detecting section 1900 and the output stop controlling signal by the electronic circuit 120 is generated, since the OR circuit 1910 generates a stop signal, the voltage generating means 1750 that receives it stops an operation and thus a voltage applied to the recording material side electrode 1430 is stopped. At this time, all of electric charges accumulated in the voltage generating means 1750 and electric charges accumulated in the recording material side electrode 1430 are discharged to the ground through the discharge resistor 1720.

As discussed in detail above, this liquid ejecting apparatus can realize an effective aerosol collecting function with a low electric field. Therefore, it is possible to utilize a liquid ejecting apparatus capable of controlling the generation of aerosol in a broad field.

Moreover, as discussed in detail above, according to an embodiment of the present invention, an applied voltage is removed immediately when a case of a liquid ejecting apparatus is opened. That is, not only an operation of a voltage generating means is stopped, but also an electric charge accumulated by an electrostatic capacity of an electrode and a circuit is discharged. Therefore, in a liquid ejecting apparatus including a satellite ink collecting mechanism, a user does not receive an electric shock even if the user touches an internal member such as an electrode.

In addition, although the present invention has been described by way of an exemplary embodiment, it should be understood that those skilled in the art might make many changes and substitutions without departing from the spirit and the scope of the present invention. It is obvious from the definition of the appended claims that embodiments with such modifications also belong to the scope of the present invention.

Moreover, as an operative example of a liquid ejecting apparatus that may be an embodiment of the present invention, although the liquid ejecting apparatus can include a color material injection system in manufacture of a color filter for a liquid crystal display, an electrode formation apparatus in manufacture of an organic EL display, FED (a plane emission display), or the like, or a sample injection head used in manufacture of a biochip, the liquid ejecting apparatus is not limited to them.

What is claimed is:

1. A liquid ejecting apparatus comprising:

a liquid ejecting head that has a conductive nozzle plate and discharges liquid from openings of the nozzle plate to recording material;

an absorbing member that is arranged opposite the nozzle plate in a direction in which liquid is discharged and absorbs the liquid not attached to the recording material;

an electrode that is arranged next to said absorbing member; and a voltage generating means that generates a voltage to electrically attract the liquid to the electrode side by applying an electric field not less than 25 kV/m and not more than 250 kV/m between the nozzle plate and the electrode.

2. The liquid ejecting apparatus as claimed in claim 1, wherein said voltage generating means applies an electric field not less than 80 kV/m between the nozzle plate and the electrode.

3. The liquid ejecting apparatus as claimed in claim 2, wherein said voltage generating means applies a low electric field between the nozzle plate and the electrode in inverse proportion to a height of a liquid column grown from the openings of the nozzle plate until the liquid column is discharged as a liquid drop.

4. The liquid ejecting apparatus as claimed in claim 1, wherein said voltage generating means applies a low electric field between the nozzle plate and the electrode in inverse proportion to a height of a liquid column grown from the openings of the nozzle plate until the liquid column is discharged as a liquid drop.

5. The liquid ejecting apparatus as claimed in claim 1, wherein said electrode is arranged to form a mesh.

6. The liquid ejecting apparatus as claimed in claim 5, wherein said electrode is mounted on and covers substantially an entire area of the top surface of said absorbing member.

7. A liquid ejecting apparatus as claimed in claim 1, further comprising:

a recording material side electrode that is arranged opposite the nozzle plate farther than the recording material in a direction in which liquid is discharged;

a voltage generating means that generates a voltage between the nozzle plate and said recording material side electrode to electrically attract the liquid to the electrode side;

an opening and closing detecting section that detects opening and closing of a case covering at least said liquid ejecting head and said recording material side electrode; and a voltage stopping means that stops generating a voltage between the nozzle plate and said recording material side electrode when said opening and closing detecting section has detected the opening of the case.

8. The liquid ejecting apparatus as claimed in claim 7, wherein said voltage stopping means electrically insulates said voltage generating means from the nozzle plate, said voltage generating means from said recording material side electrode, or said voltage generating means from the nozzle plate and said recording material side electrode.

9. The liquid ejecting apparatus as claimed in claim 7, wherein said voltage stopping means prohibits said voltage generating means from generating a voltage.

10. The liquid ejecting apparatus as claimed in claim 7, wherein the liquid ejecting apparatus further comprises an error detecting section that detects an operating error of the liquid ejecting apparatus, and said voltage stopping means stops generating a voltage between the nozzle plate and said recording material side electrode when said error detecting section detects an operating error.

11. The liquid ejecting apparatus as claimed in claim 7, wherein the liquid ejecting apparatus further comprises an attachment and detachment detecting section that detects whether a detachable ink cartridge for supplying ink to said liquid ejecting head is in attaching and detaching work, and said voltage stopping means stops generating a voltage between the nozzle plate and said recording material side electrode when said attachment and detachment detecting section detects that the ink cartridge is in attaching and detaching work.

12. The liquid ejecting apparatus as claimed in claim 7, further comprising a charge discharging means that discharges electric charge accumulated in at least one of said recording material side electrode and said voltage generating means when said voltage stopping means is operated.

13. A liquid collecting system comprising:

a liquid ejecting head that has a conductive nozzle plate and discharges liquid from openings of the nozzle plate to recording material;

an absorbing member that is arranged opposite the nozzle plate in a direction in which liquid is discharged and absorbs the liquid not attached to the recording material;

an electrode that is arranged next to the absorbing member; and a voltage generating means that generates a voltage to electrically attract the liquid to the electrode side by applying an electric field not less than 25 kV/m and not more than 250 kV/m between the nozzle plate and the electrode.

14. The liquid collecting system as claimed in claim 13, wherein said electrode is arranged to form a mesh.

15. The liquid collecting system as claimed in claim 14, wherein said electrode is mounted on and covers substantially an entire area of the top surface of said absorbing member.

16. A recording apparatus comprising:

a recording head that has a conductive nozzle plate and discharges liquid from openings of the nozzle plate to recording material;

an absorbing member that is arranged opposite the nozzle plate in a direction in which liquid is discharged and absorbs the liquid not attached to the recording material;

an electrode that is arranged next to the absorbing member; and a voltage generating means that generates a voltage to electrically attract the liquid to the electrode side by applying an electric field not less than 25 kV/m and not more than 250 kV/m between the nozzle plate and the electrode.

17. The recording apparatus as claimed in claim 16, wherein said electrode is arranged to form a mesh.

18. The liquid collecting system as claimed in claim 17, wherein said electrode is mounted on and covers substantially an entire area of the top surface of said absorbing member.

19. An absorbing member that is arranged opposite a recording head in a recording apparatus for discharging ink from the recording head to recording material, wherein the absorbing member is formed of a conductive porous material of which surface resistance has a resistance value not more than $10^8\Omega$.

20. An ink collecting unit that is arranged opposite a recording head in a recording apparatus for discharging ink from the recording head to recording material, comprising:

an absorbing member that is formed of a conductive porous material of which surface resistance has a resistance value not more than $10^8\Omega$; and a platen that accommodates said absorbing member and supports the recording material.

21. The ink collecting unit as claimed in claim 20, further comprising an electrode that is electrically connected to said absorbing member.

22. The ink collecting unit as claimed in claim 21, wherein said electrode is arranged to form a mesh.

23. The ink collecting unit as claimed in claim 22, wherein said electrode is mounted on and covers substantially an entire area of the top surface of said absorbing member.

* * * * *